US009310719B2

(12) United States Patent
Eto

(10) Patent No.: US 9,310,719 B2
(45) Date of Patent: Apr. 12, 2016

(54) DEVELOPER CONTAINER AND IMAGE FORMING APPARATUS INCLUDING THE SAME

(71) Applicant: KYOCERA Document Solutions Inc., Osaka-shi, Osaka (JP)

(72) Inventor: Daisuke Eto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 14/785,509

(22) PCT Filed: Jan. 9, 2015

(86) PCT No.: PCT/JP2015/050431
§ 371 (c)(1),
(2) Date: Oct. 19, 2015

(87) PCT Pub. No.: WO2015/111445
PCT Pub. Date: Jul. 30, 2015

(65) Prior Publication Data

US 2016/0062269 A1 Mar. 3, 2016

(30) Foreign Application Priority Data

Jan. 23, 2014 (JP) ..... 2014-010534

(51) Int. Cl.
*G03G 15/08* (2006.01)

(52) U.S. Cl.
CPC ..... *G03G 15/0881* (2013.01)

(58) Field of Classification Search
USPC ..... 399/91, 98, 102, 103, 106, 107, 110, 399/111, 119, 120; 222/DIG. 1
See application file for complete search history.

(56) References Cited

U.S. PATENT DOCUMENTS

| | | | | |
|---|---|---|---|---|
| 6,560,422 | B2 * | 5/2003 | Kanno | G03G 15/0882 399/106 |
| 8,867,955 | B2 * | 10/2014 | Yamaguchi | G03G 15/0881 399/106 |
| 2002/0018668 | A1 | 2/2002 | Kanno et al. | |
| 2006/0008289 | A1 | 1/2006 | Sato et al. | |
| 2008/0240773 | A1 | 10/2008 | Sato et al. | |
| 2009/0074454 | A1 | 3/2009 | Sato et al. | |

FOREIGN PATENT DOCUMENTS

| | | |
|---|---|---|
| JP | 9-6214 | 1/1997 |
| JP | 9-212065 | 8/1997 |

(Continued)

OTHER PUBLICATIONS

International Search Report.

*Primary Examiner* — Hoan Tran
(74) *Attorney, Agent, or Firm* — Gerald E. Hespos; Michael J. Porco; Matthew T. Hespos

(57) ABSTRACT

A developer container includes a housing, a sealing member, and a winder mechanism. The housing includes a storage space and an opening. The sealing member is attached to the housing and sealing the opening. The winder mechanism winds up the sealing member while peeling the sealing member from the housing. The winder mechanism includes an interrupting member operable to interrupt transmission of a torque of a drive transmission mechanism owing to a tension of the sealing member caused by peeling a fold side of the sealing member that includes a first end from the housing.

10 Claims, 27 Drawing Sheets

(56) References Cited

FOREIGN PATENT DOCUMENTS

| | | |
|---|---|---|
| JP | 9-274381 | 10/1997 |
| JP | 2002-6609 | 1/2002 |
| JP | 2003-215895 | 7/2003 |
| JP | 2006-23340 | 1/2006 |

* cited by examiner

DEVELOPER CONTAINER AND IMAGE FORMING APPARATUS INCLUDING THE SAME

TECHNICAL FIELD

The present invention relates to a developer container for containing developer and an image forming apparatus including the developer container.

BACKGROUND ART

Conventionally, process cartridges such as one disclosed in Japanese Unexamined Patent Publication No. HEI 9-6214 are known as developer containers for containing developer. The process cartridge includes a photoconductive member and a developing device. In the developing device, a partition wall separating a toner container containing toner and a development chamber is formed with an opening for toner supply. A toner sealing member is thermally welded over this opening. In order to begin use of the process cartridge, the toner sealing member is wound up by a winder mechanism to open the opening.

The winder mechanism includes an interrupting mechanism operable to interrupt transmission of a driving force to a winder member upon completion of the opening, i.e. when the toner sealing member is wound up around the winder member. A change in the magnitude relationship between a winding torque of peeling the toner sealing member and a predetermined biasing force of a spring member causes disengagement of a drive transmission gear, consequently interrupting the driving force transmission.

SUMMARY OF INVENTION

In the winder mechanism of the process cartridge disclosed in Japanese Unexamined Patent Publication No. HEI 9-6214, the driving force transmission is interrupted by utilizing a decrease in winding torque which occurs when the toner sealing member is completely peeled from the opening. However, the winding torque of peeling the toner sealing member is liable to vary depending on the welding condition. Therefore, there is a problem that the driving force transmission may be accidentally interrupted during the winding operation, so that the winding operation cannot be continued.

The present invention aims to provide a developer container capable of peeling a sealing member sealing an opening automatically and reliably, and an image forming apparatus including the developer container.

A developer container according to an aspect of the present invention comprises a housing, a sealing member, and a winder mechanism. The housing includes a storage space configured to contain developer, and an opening having a longer dimension and communicating with the storage space for allowing the developer to flow therethrough. The sealing member is attached to the housing and seals the opening in a longitudinal direction of the opening. The winder mechanism winds up the sealing member while peeling the sealing member from the housing. The sealing member is in a folded state that a first end of the sealing member and a second end opposite to the first end are disposed on one end of the housing in the longitudinal direction and a crease of the sealing member is on the other end of the housing in the longitudinal direction with a sealing surface of the sealing member sealing the opening. The winder mechanism includes a winder shaft disposed at the one end of the housing in the longitudinal direction and fixedly holding the second end of the sealing member, a drive transmission mechanism configured to transmit a torque to the winder shaft, and an interrupting member fixedly holding the first end of the sealing member and connected to the drive transmission mechanism, the interrupting member being operable to interrupt the transmission of the torque of the drive transmission mechanism owing to a tension of the sealing member caused by peeling the first end fold side of the sealing member from the housing.

An image forming apparatus according to another aspect of the present invention comprises: an image carrier having a surface for allowing an electrostatic latent image to be formed thereon and operable to carry a developed image formed by visualizing the electrostatic latent image by developer; the above-described developer container configured to contain the developer; and a transfer section configured to transfer the developed image from the image carrier onto a sheet.

The present invention provides a developer container capable of peeling a sealing member sealing an opening automatically and reliably, and an image forming apparatus including the developer container.

DESCRIPTION OF EMBODIMENTS

Figure 1:
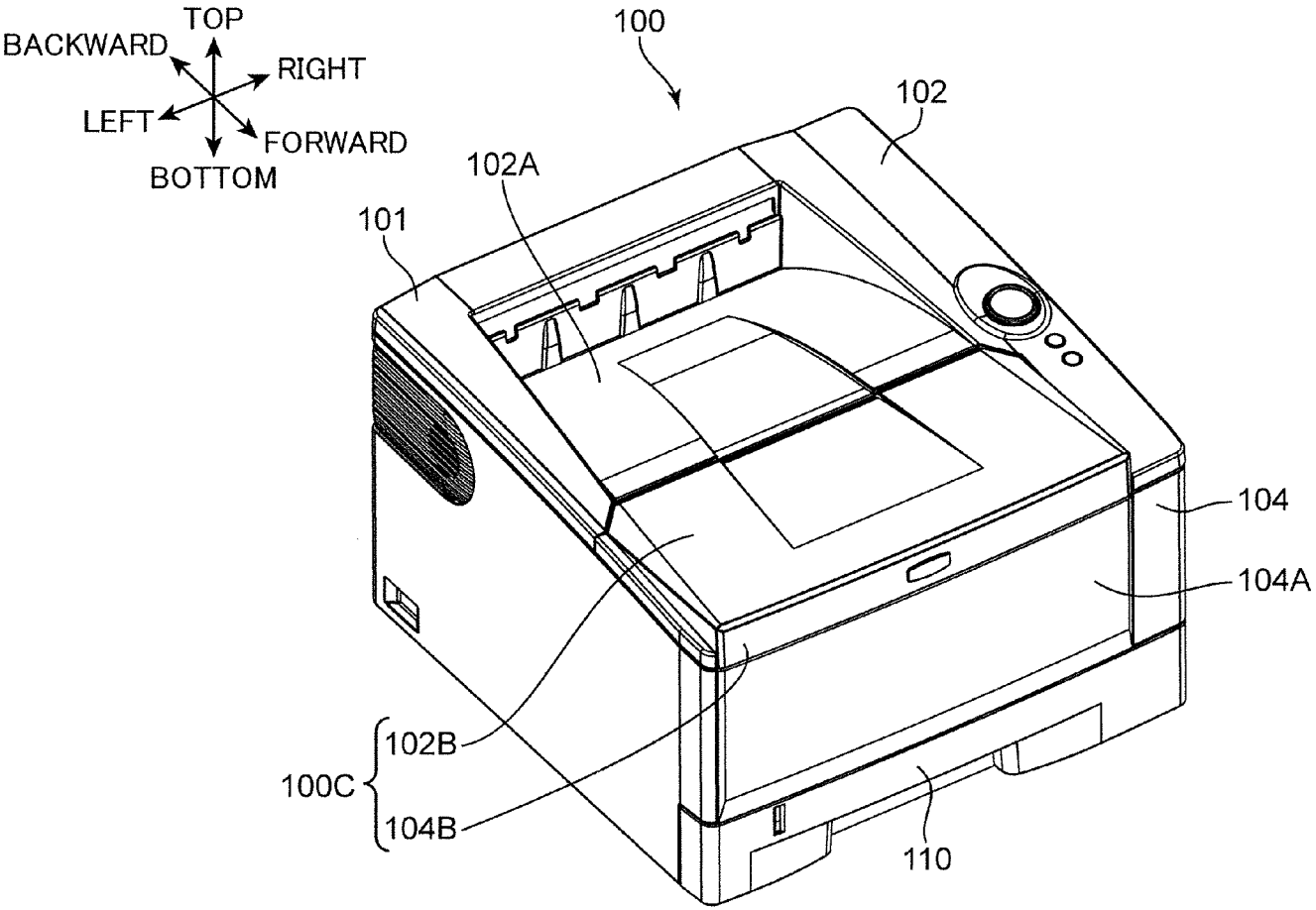
FIG. 1 is a perspective view of an image forming apparatus according to an embodiment of the present invention.
Figure 2:
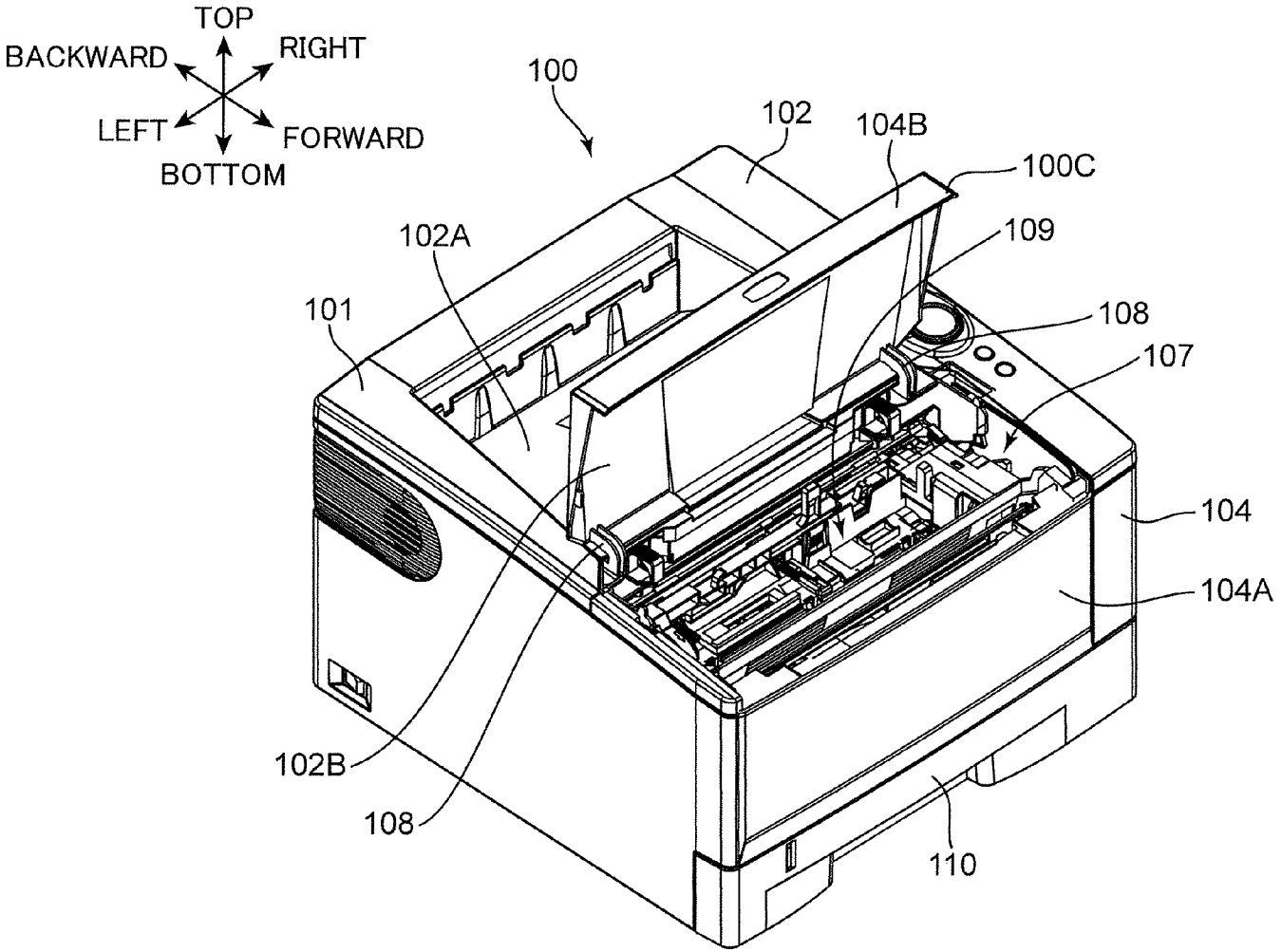
FIG. 2 is a perspective view of the image forming apparatus according to the embodiment of the present invention, a part of the apparatus being opened.
Figure 3:
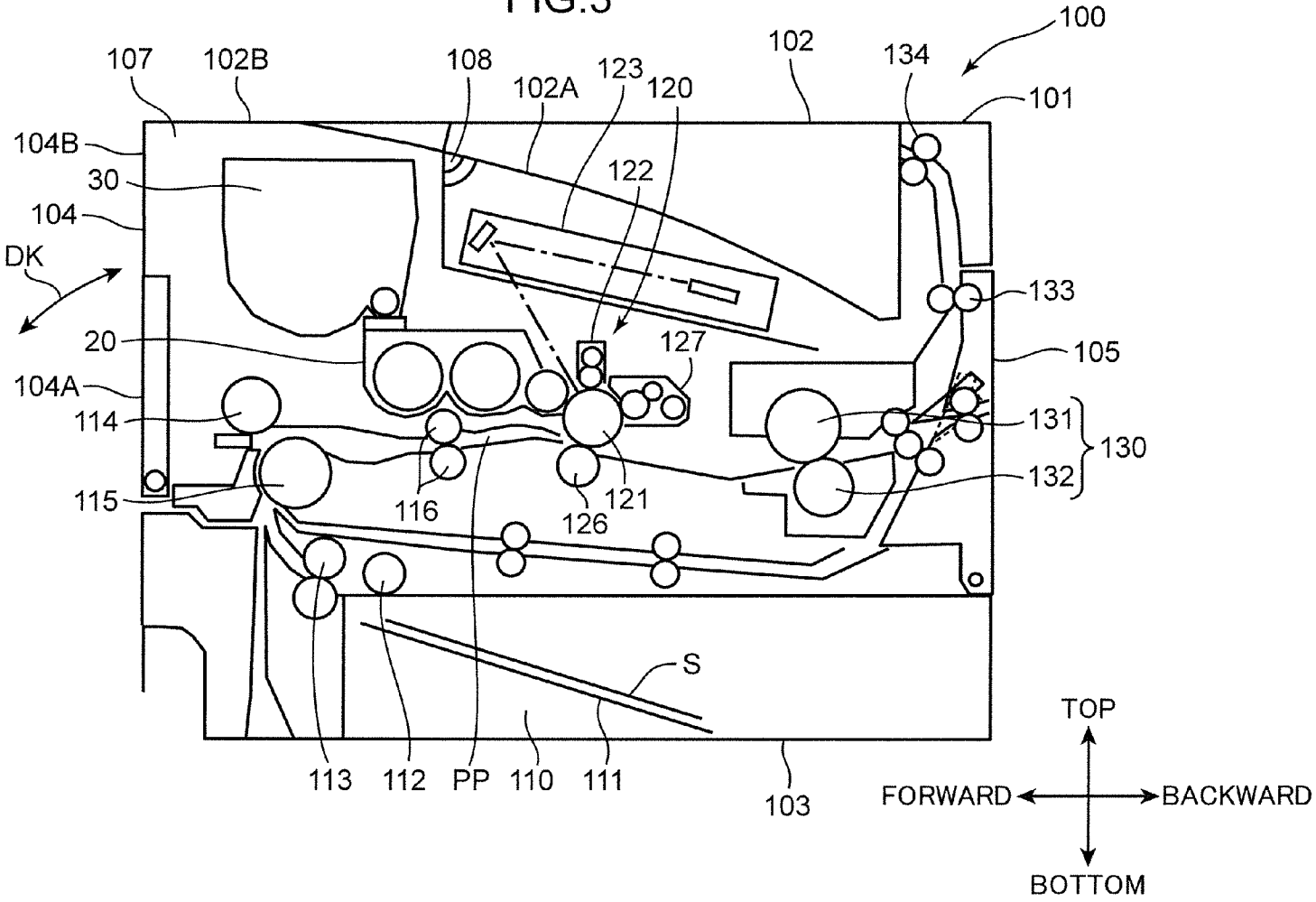
FIG. 3 is a schematic sectional view showing an internal structure of the image forming apparatus according to the embodiment of the present invention.

Hereinafter, an embodiment of the present invention will be described with reference to the accompanying drawings. FIGS. 1 and 2 are perspective views of a printer 100 (image forming apparatus) according to an embodiment of the present invention. FIG. 3 is a schematic sectional view showing an internal structure of the printer 100 shown in FIGS. 1 and 2. The printer 100 shown in FIGS. 1 to 3, which exemplifies the image forming apparatus, is configured as a so-called monochrome printer. However, other apparatuses may alternatively be provided as an image forming apparatus in other embodiments, such as a color printer, a facsimile apparatus or a multifunctional apparatus equipped with these functions, or another type of apparatus for forming a toner image on a sheet. It should be noted that hereinafter, terms indicating directions such as "top" "bottom" "forward" "backward" "left" and "right" are intended merely for descriptive purposes, and not for limiting the principle of the image forming apparatus.

The printer 100 includes a housing 101 for housing various components that are used for forming an image on a sheet S. The housing 101 includes a top wall 102 defining the top surface of the housing 101, a bottom wall 103 (FIG. 3) defining the bottom surface of the housing 101, a main body rear wall 105 (FIG. 3) connecting the top wall 102 and the bottom wall 103, and a main body front wall 104 located in front of the main body rear wall 105. The housing 101 includes a main body internal space 107 where various components are placed. A sheet conveyance passage PP extends in the main body internal space 107 of the housing 101, the sheet conveyance passage PP for allowing passage of a sheet S in a given conveying direction. Further, the printer 100 includes an opening/closing cover 100C mounted on the housing 101 in an openable and closable manner.

The opening/closing cover 100C includes a front wall upper portion 104B constituting an upper portion of the main body front wall 104, and a top wall front portion 102B constituting a front portion of the top wall 102. The opening/closing cover 100C can be vertically opened and closed with unillustrated hinge shafts acting as a fulcrum, the hinge shafts being respectively disposed on a pair of arms 108 disposed at lateral opposite ends of the opening/closing cover 100C (FIG. 2). When the opening/closing cover 100C is open, the main body internal space 107 is exposed to the outside at the top thereof. On the other hand, when the opening/closing cover 100C is closed, the main body internal space 107 is closed at the top thereof. A developing device 20 and a toner container 30 described later are mounted in a development housing compartment 109 formed in the main body internal space 107.

A sheet discharge section 102A is disposed in a central part of the top wall 102. The sheet discharge section 102A includes an oblique surface sloping downward from a front end to a rear end of the top wall 102. A sheet S that has been subjected to image formation in an image forming section 120 described later is discharged onto the sheet discharge section 102A. Further, a manual feed tray 104A is disposed in a vertically central part of the main body front wall 104. The manual feed tray 104A is vertically pivotable with a lower end thereof acting as a fulcrum (in the direction of an arrow DK shown in FIG. 3).

With reference to FIG. 3, the printer 100 includes a cassette 110, a pickup roller 112, a first sheet feeding roller 113, a second sheet feeding roller 114, a conveying roller 115, a pair of registration rollers 116, the image forming section 120, and a fixing device 130.

The cassette 110 stores sheets S therein. The cassette 110 includes a lift plate 111. The lift plate 111 is tilted to lift the leading edges of the sheets S. The cassette 110 can be pulled out forwardly with respect to the housing 101.

The pickup roller 112 is disposed above the leading edges of sheets S lifted by the lift plate 111. The pickup roller 112 rotates to draw a sheet S from the cassette 110.

The first sheet feeding roller 113 is disposed downstream of the pickup roller 112 and conveys a sheet S further downstream. The second sheet feeding roller 114 is disposed at the inner side (rear side) of the fulcrum of the manual feed tray 104A and draws a sheet placed on the manual feed tray 104A into the housing 101.

The conveying roller 115 is disposed downstream of the first sheet feeding roller 113 and the second sheet feeding roller 114 in their sheet conveying direction (hereinafter, the sheet conveying direction also being simply referred to as "conveying direction", and the downstream in the sheet conveying direction also being simply referred to as "downstream"). The conveying roller 115 conveys a sheet S fed by the first sheet feeding roller 113 or the second sheet feeding roller 114 further downstream.

The pair of registration rollers 116 functions to correct the angle of a sheet S that has been obliquely conveyed. This makes it possible to adjust the position of an image to be formed on the sheet S. The pair of registration rollers 116 supplies the sheet S to the image forming section 120 in accordance with timing of image formation to be performed by the image forming section 120.

The image forming section 120 includes a photoconductive drum 121 (image carrier), a charger 122, an exposure device 123, the developing device 20 (developer container), the toner container 30, a transferring roller 126 (transfer section), and a cleaning device 127.

The photoconductive drum 121 is in the form of a cylinder. The photoconductive drum 121 has a surface to be formed with an electrostatic latent image, and carries a toner image (developed image) corresponding to the electrostatic latent image on the surface. The charger 122 is applied with a predetermined voltage, and charges the circumferential surface of the photoconductive drum 121 substantially uniformly.

The exposure device 123 irradiates the circumferential surface of the photoconductive drum 121 charged by the charger 122 with beams of laser light. The beams of laser light are emitted in accordance with image data output from an external device (not shown) such as a personal computer which is communicably connected to the printer 100. Consequently, the circumferential surface of the photoconductive drum 121 is formed with an electrostatic latent image corresponding to the image data.

The developing device 20 supplies toner to the circumferential surface of the photoconductive drum 121, the circumferential surface being formed with an electrostatic latent image. The toner container 30 supplies toner to the developing device 20. The toner container 30 is detachably attached to the developing device 20. The developing device 20 supplies the toner to the photoconductive drum 121 to develop (visualize) the electrostatic latent image formed on the circumferential surface of the photoconductive drum 121. Consequently, the circumferential surface of the photoconductive drum 121 is formed with a toner image (developed image).

The transferring roller 126 is disposed below and opposite the photoconductive drum 121 across the sheet conveyance passage PP. The transferring roller 126 defines a transfer nip in cooperation with the photoconductive drum 121 for transferring a toner image onto a sheet S.

The cleaning device 127 removes, after a toner image is transferred onto a sheet S from the circumferential surface of the photoconductive drum 121, toner remaining on the circumferential surface.

The fixing device 130 is disposed downstream of the image forming section 120 in the conveying direction, and fixes a toner image on a sheet S. The fixing device 130 includes a heating roller 131 for melting toner on the sheet S, and a pressure roller 132 for bringing the sheet S into close contact with the heating roller 131.

The printer 100 further includes a pair of conveying rollers 133 disposed downstream of the fixing device 130, and a pair of discharge rollers 134 disposed downstream of the pair of conveying rollers 133. A sheet S is conveyed upward by the pair of conveying rollers 133 to be finally discharged from the housing 101 by the pair of discharge rollers 134. The sheet S discharged from the housing 101 is placed on the sheet discharge section 102A, thereby resulting in a stack of sheets.

<Developing Device>

Figure 4:
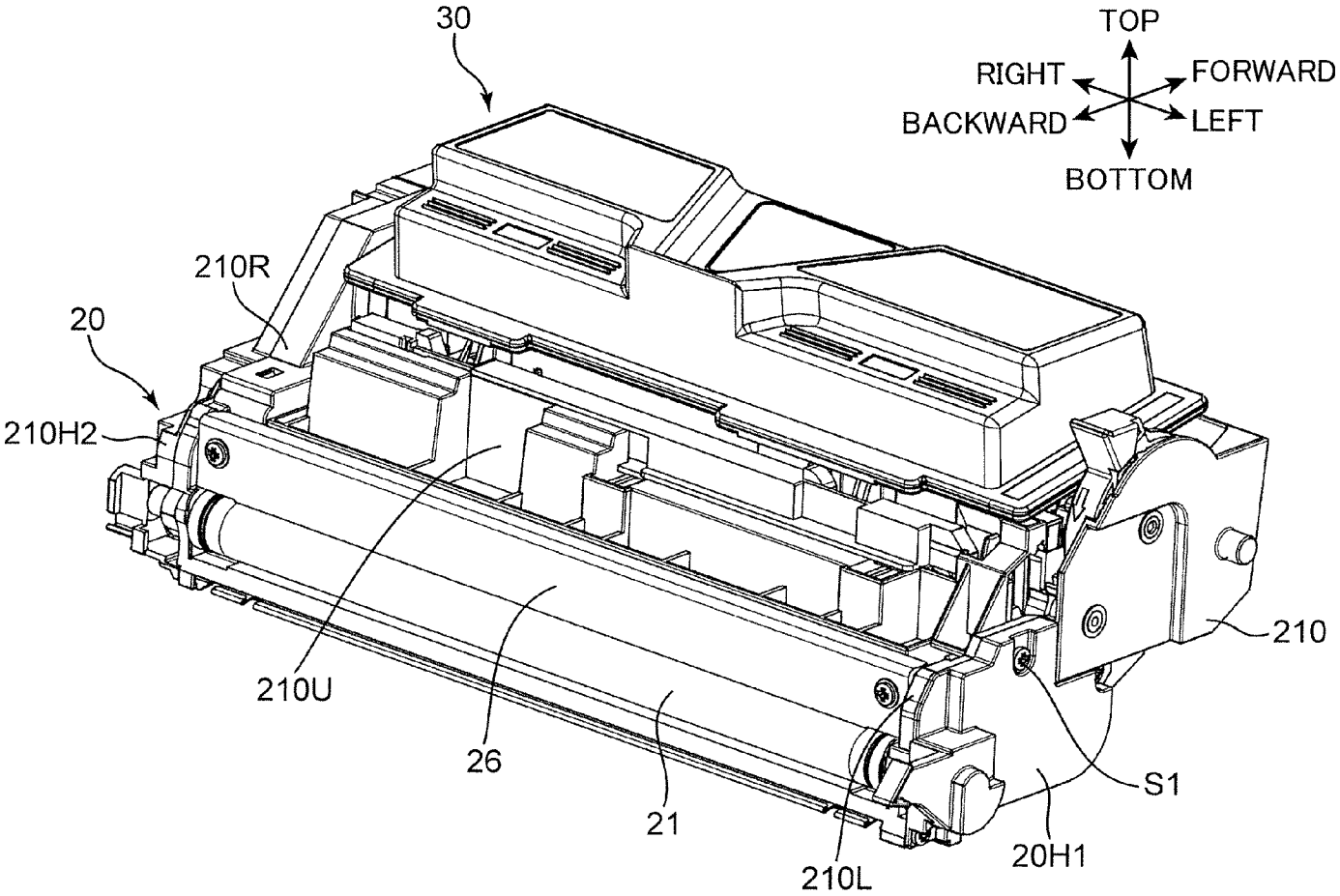
FIG. 4 is a perspective view of a developing device and a toner container according to the embodiment of the present invention.
Figure 5:
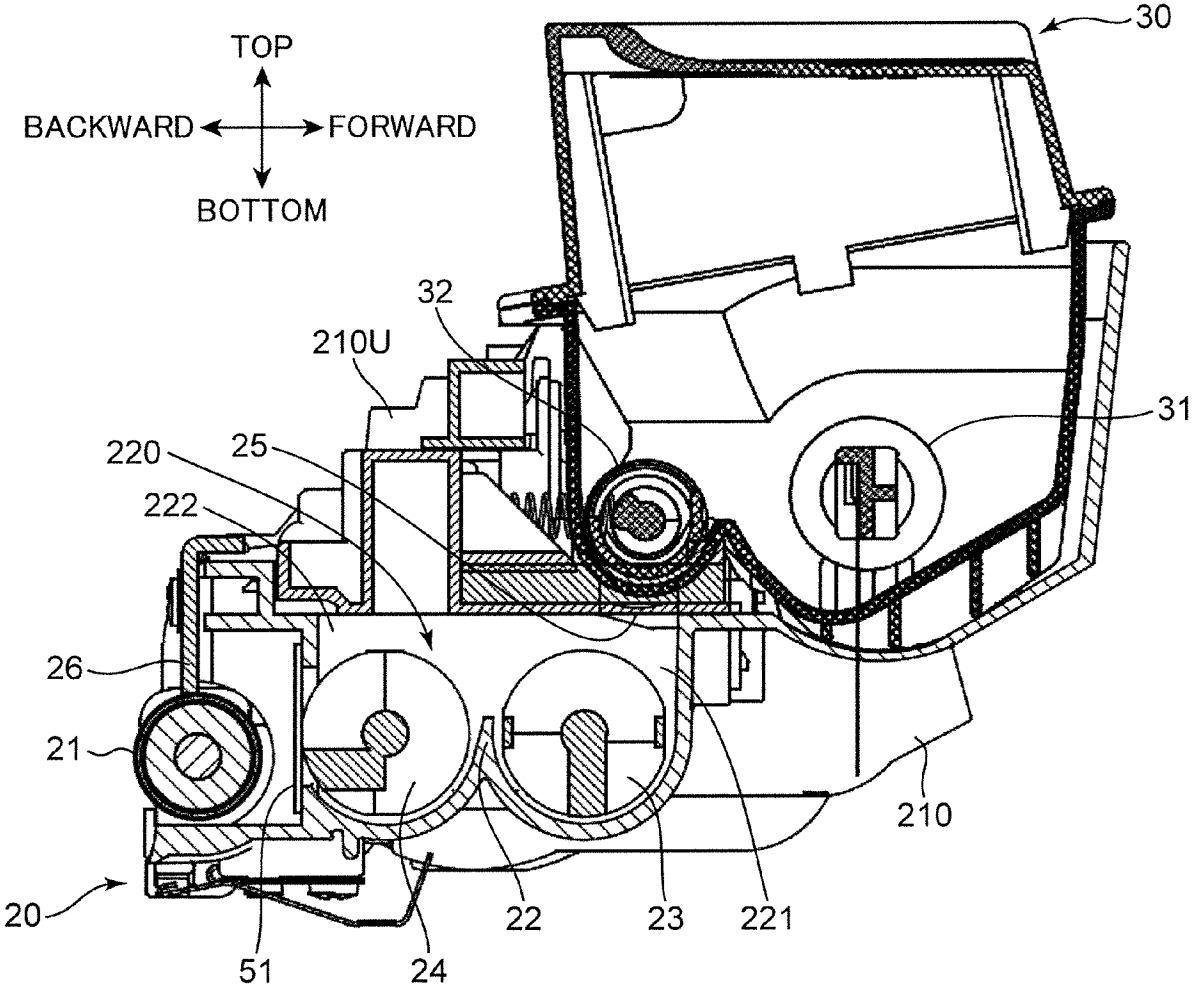
FIG. 5 is a sectional view of the developing device and the toner container according to the embodiment of the present invention.
Figure 6:
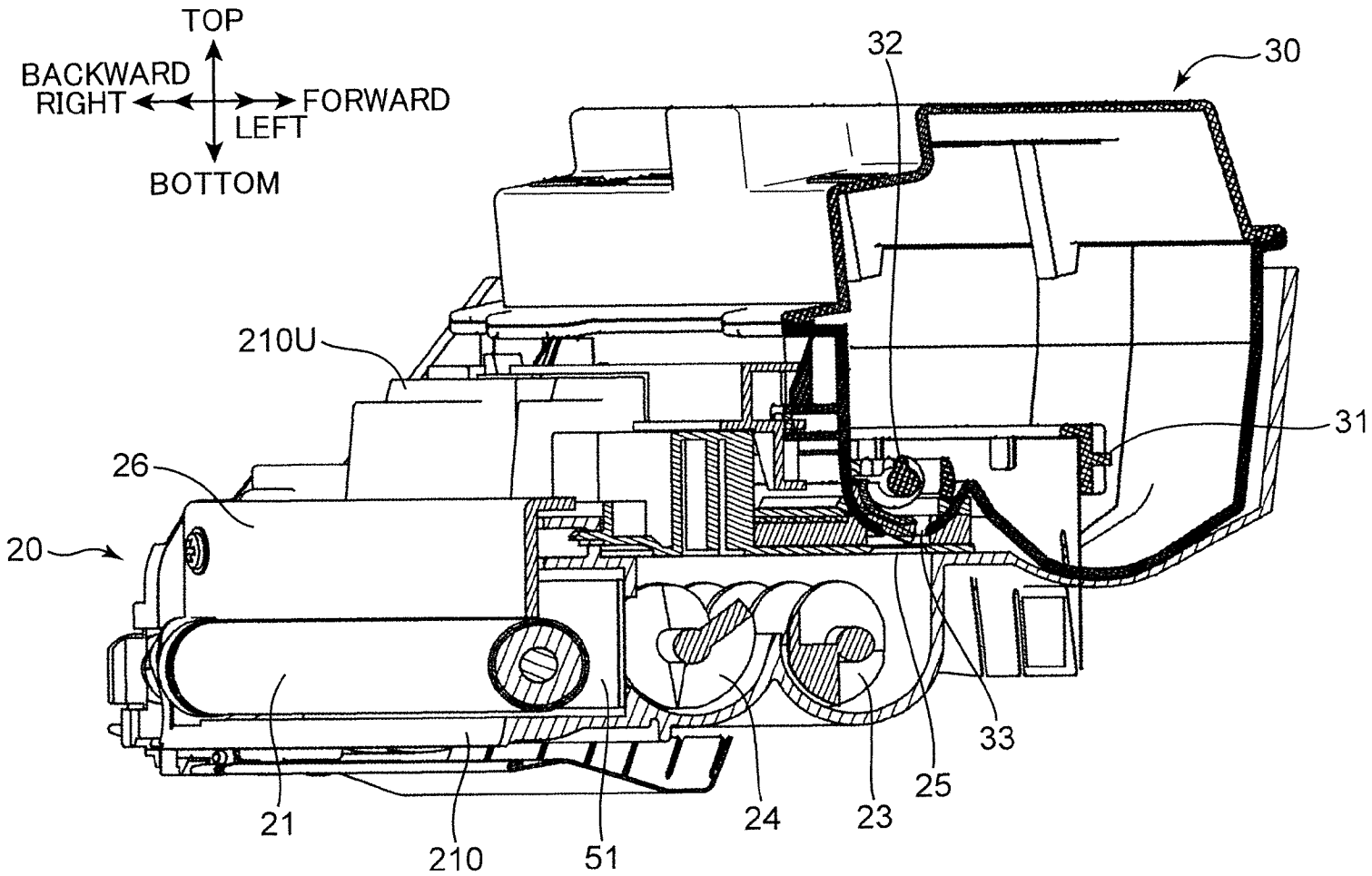
FIG. 6 is sectional perspective view of the developing device and the toner container according to the embodiment of the present invention.
Figure 7:
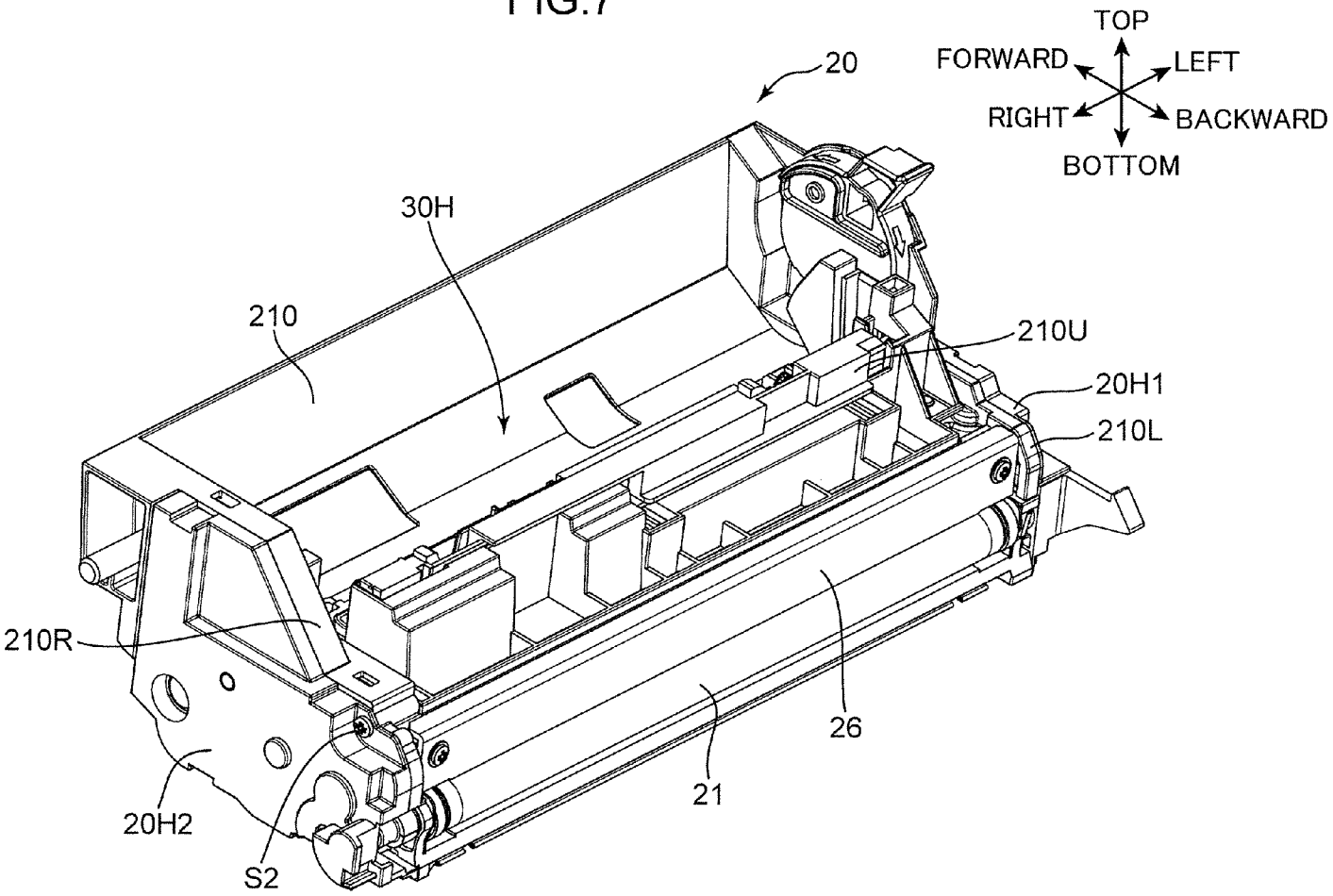
FIG. 7 is a perspective view of the developing device according to the embodiment of the present invention.
Figure 8:
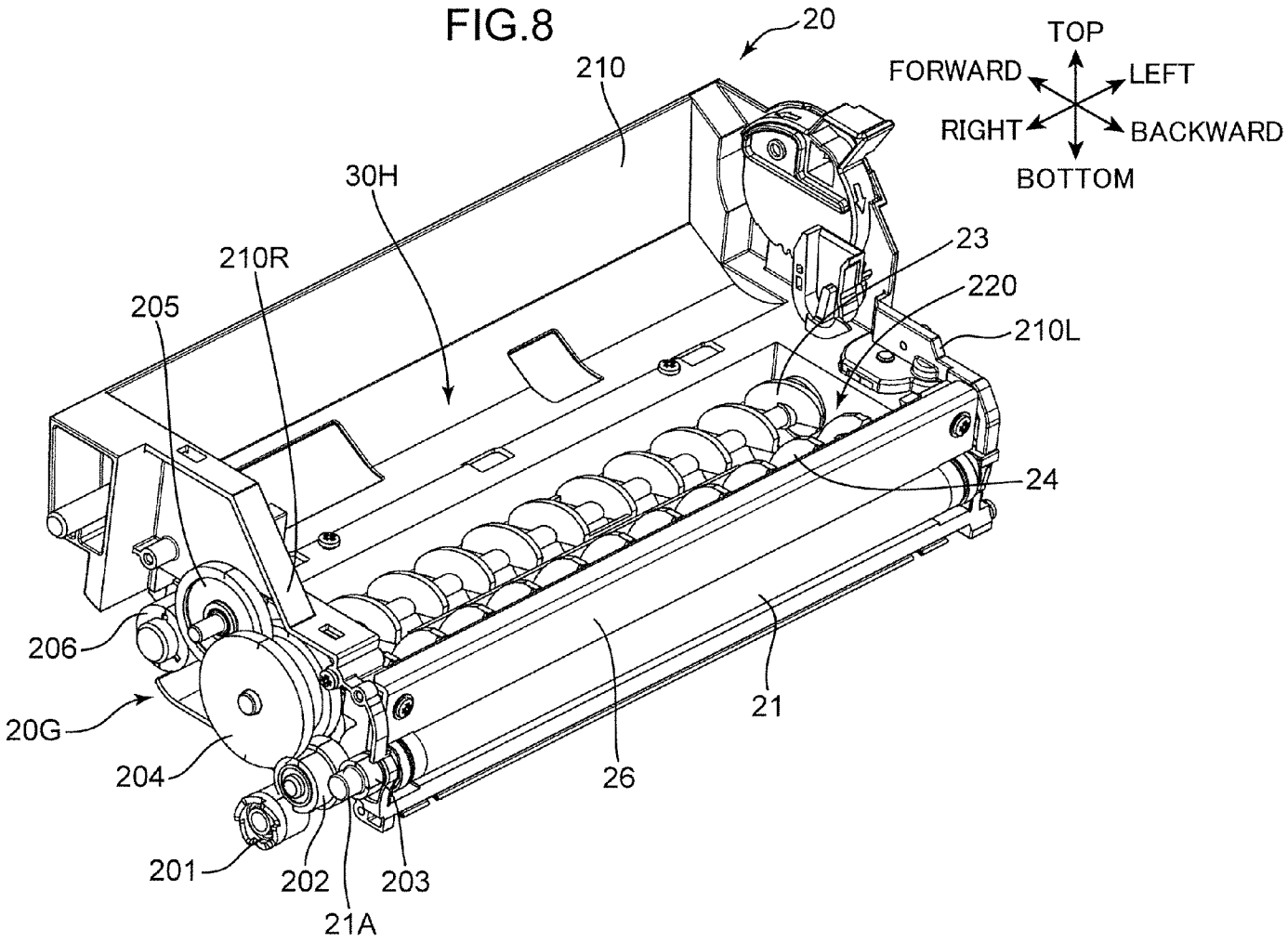
FIG. 8 is a perspective view showing the inside of the developing device according to the embodiment of the present invention.
Figure 9:
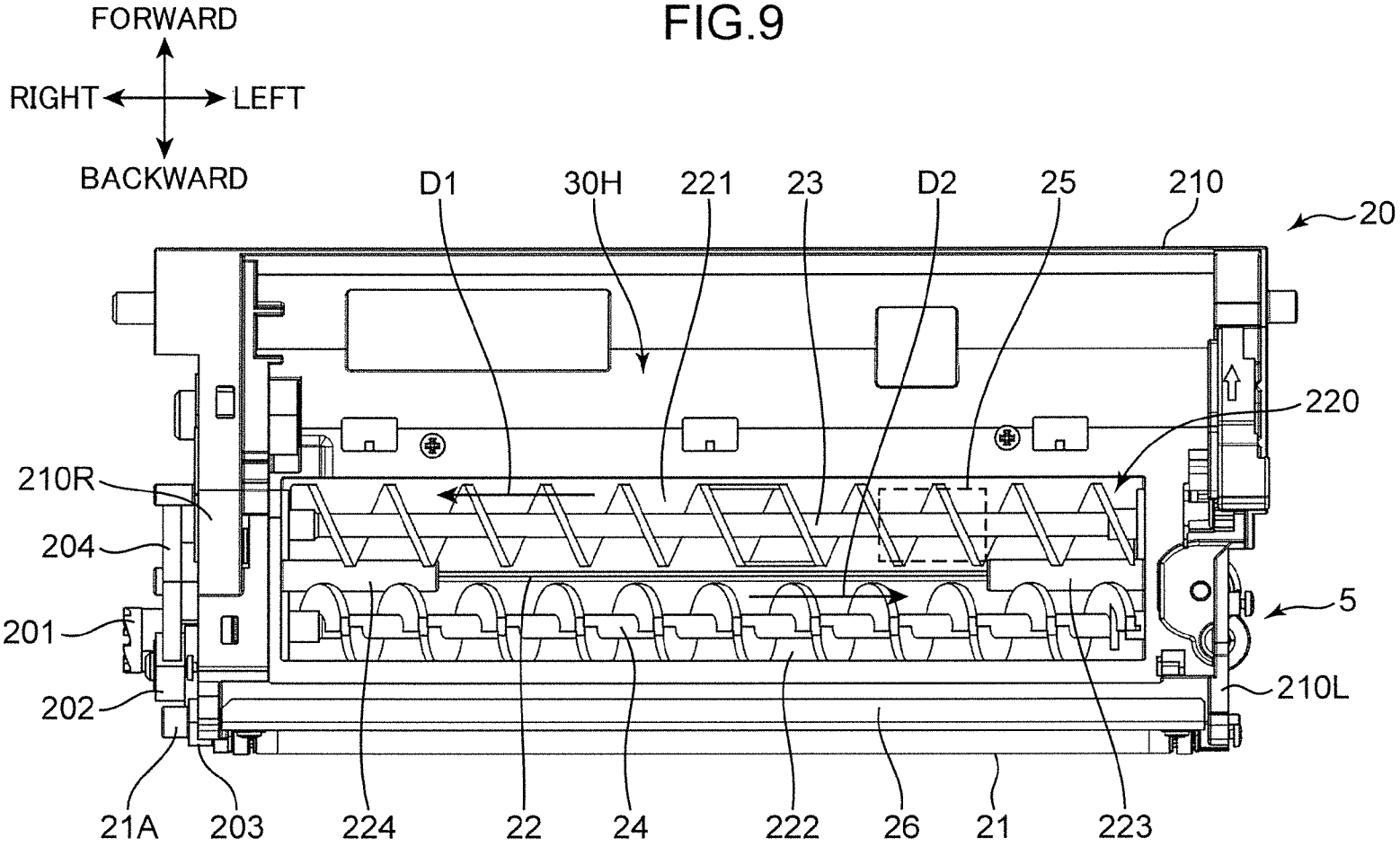
FIG. 9 is a plan view showing the inside of the developing device according to the embodiment of the present invention.

Now the developing device 20 and the toner container 30 according to this embodiment will be described in detail with reference to FIGS. 4 to 9. FIG. 4 is a perspective view of the developing device 20 and the toner container 30 according to this embodiment. FIG. 5 is a sectional view of the developing device 20 and the toner container 30. FIG. 6 is a sectional perspective view of the developing device 20 and the toner container 30. FIG. 7 is a perspective view of the developing device 20 shown alone. FIG. 8 is a perspective view showing the inside of the developing device 20. FIG. 9 is a plan view showing the inside of the developing device 20.

The developing device 20 includes a development housing 210 (housing) in the form of a box having a longer dimension in a specific direction (an axial direction of a developing roller 21 or a left-right direction), a ceiling plate 210U, a left cover 20H1, and a right cover 20H2. The development housing 210 defines an enclosure of the developing device 20. As shown in FIG. 5, the developing roller 21, a first stirring screw 23, and a second stirring screw 24 are disposed in a rear portion of the development housing 210. Further, in a front portion of the development housing 210, a container housing portion 30H (FIG. 7) is disposed in which the toner container 30 is mounted. The development housing 210 includes a pair of lateral side walls, i.e. a right wall 210R and a left wall 210L (FIGS. 4 and 7).

The ceiling plate 210U is mounted to the rear portion of the development housing 210 from above. The ceiling plate 210U covers a storage space 220 described later from above. The left cover 20H1 (FIG. 4) is mounted to cover the left wall 210L of the development housing 210 from the left side. The left cover 20H1 functions to protect a seal winder mechanism 5 described later. The right cover 20H2 (FIG. 7) is mounted to cover the right wall 201R of the development housing 210 from the right side. The right cover 20H2 functions to protect a developing device driving mechanism 20G described later. The left cover 20H1 and the right cover 20H2 are secured to the left wall 210L and the right wall 210R by screws S1 and S2, respectively.

The development housing 210 includes the storage space 220 (FIGS. 5 and 8) (storage space). Toner is contained in the storage space 220. In the storage space 220, the first stirring screw 23 (conveying member), the second stirring screw 24, and a toner supply port 25 are disposed. This embodiment employs a one-component developing method and, therefore, the storage space 220 is filled with magnetic toner that is to be used as developer. On the other hand, in the case of a two-component developing method, a mixture of toner and carrier including a magnetic material is filled as developer. The toner is circulatively conveyed in the storage space 220 and successively supplied from the developing roller 21 to the photoconductive drum 121 in order to develop an electrostatic latent image.

Figure 11A:
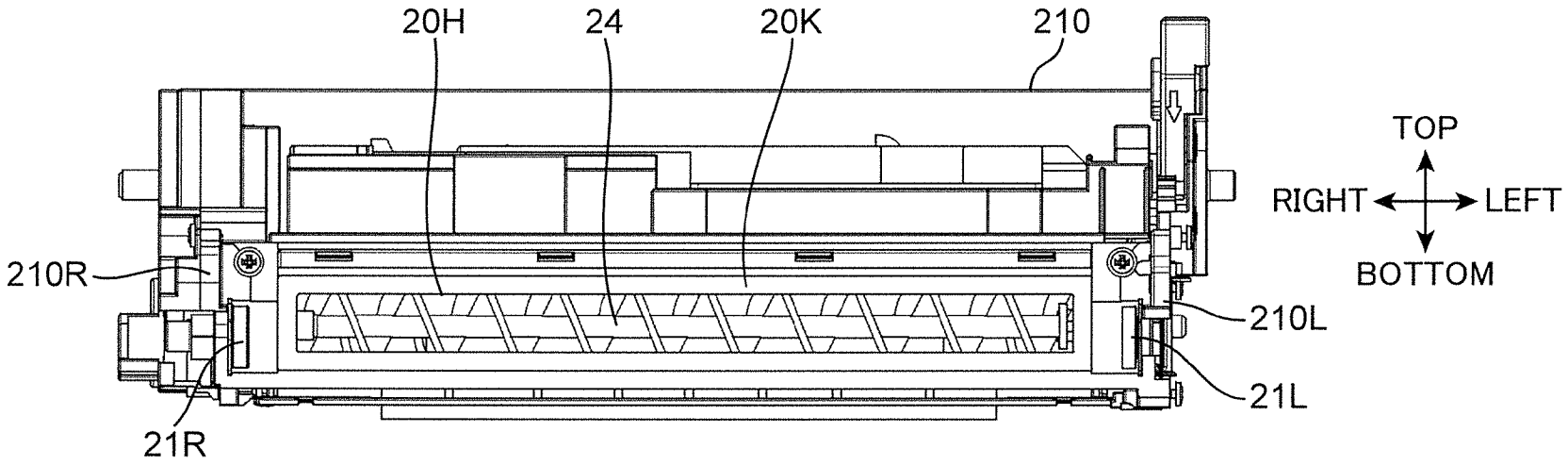
FIG. 11A is a front view of the developing device according to the embodiment of the present invention with a developing roller dismounted and a sealing member peeled off.
Figure 11B:
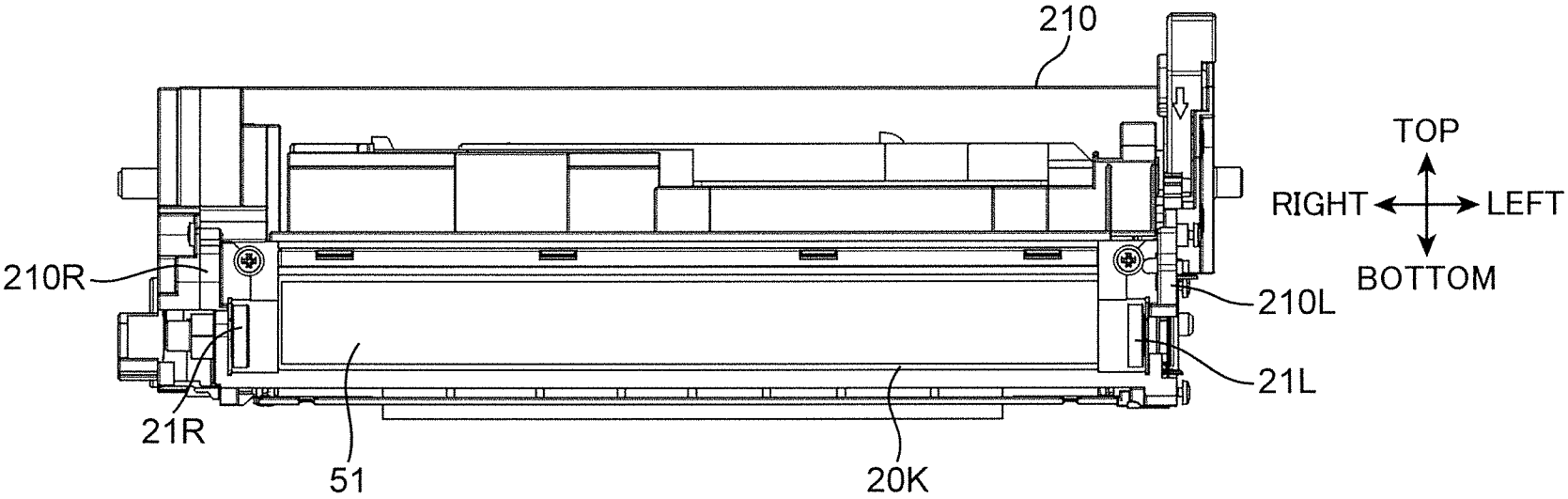
FIG. 11B is a front view similar to FIG. 11A, but with the sealing member being attached.
Figure 12A:
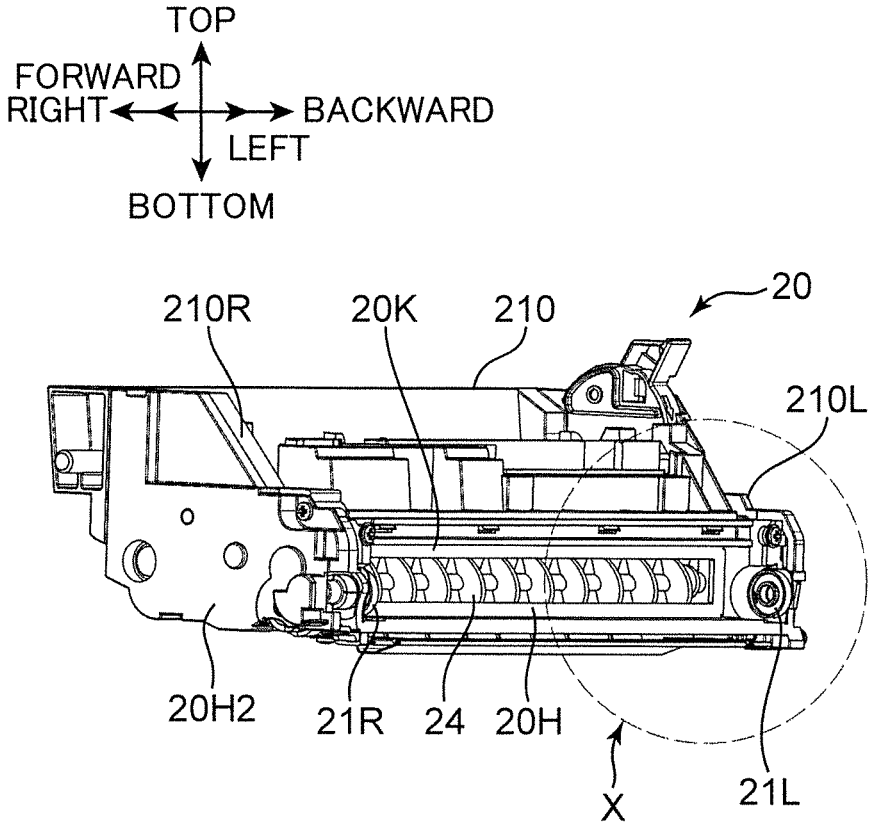
FIG. 12A is a perspective view of the developing device shown in FIG. 11A.

The developing roller 21 is disposed adjacently behind the storage space 220 and rotatably supported on the development housing 210. The developing roller 21 is in the form of a cylinder extending in a longitudinal direction of the development housing 210, and includes a sleeve constituting a circumferential portion of the developing roller 21 and configured to be rotationally driven. The developing roller 21 includes therein a stationary magnet having a plurality of magnetic poles. The developing roller 21 is rotatably supported by a right bearing 21R and a left bearing 21L provided in the right wall 210R and the left wall 210L, respectively, as shown in FIGS. 11B and 12A described later.

The storage space 220 of the development housing 210 is covered by the above-mentioned ceiling plate 210U and divided, by a partition plate 22 extending in the left-right direction, into a first conveyance passage 221 and a second conveyance passage 222 having a longer dimension in the left-right direction (FIG. 9). The partition plate 22 is shorter than the lateral width of the development housing 210 to define a first communication passage 223 and a second communication passage 224 on the left and right sides of the partition plate 22, the first and second communication passages 223 and 224 each allowing communication between the first conveyance passage 221 and the second conveyance passage 222. Consequently, there is a circulation passage constituted by the first conveyance passage 221, the second communication passage 224, the second conveyance passage 222, and the first communication passage 223 in the storage space 220. The toner is conveyed through the circulation passage counterclockwise in FIG. 9.

The toner supply port 25 (FIG. 9) is an opening formed in the ceiling plate 210U and is disposed near and above a left end of the first conveyance passage 221. The toner supply port 25 faces the above-mentioned circulation passage, and functions to allow replenishment toner (replenishment developer) supplied from the toner container 30 to flow into the storage space 220.

The first stirring screw 23 is disposed in the first conveyance passage 221. The first stirring screw 23 includes a rotary shaft and a spiral blade in the form of a helix protruding from the circumferential surface of the rotary shaft. The first stirring screw 23 is driven to rotate around its rotational axis to convey toner in the direction of an arrow D1 shown in FIG. 9. The first stirring screw 23 conveys toner so that the toner passes through a portion of the first conveyance passage 221 that faces the toner supply port 25. This allows the first stirring screw 23 to mix new toner flowing in from the toner supply port 25 with the toner being conveyed in the first conveyance passage 221 and then deliver the mixed toner to the second conveyance passage 222. As shown in FIG. 9, rib members are disposed downstream of the toner supply port 25 in the arrow D1 direction, the rib members each connecting a particular advancing point and a particular receding point of a turn of the screw blade of the first stirring screw 23. The rib members partially reduce the developer conveying ability to create a developer accumulation portion under the toner supply port 25. When the amount of developer in the storage space 220 decreases, the volume of developer accumulation portion decreases such that replenishment toner is allowed to flow in through the toner supply port 25. On the other hand, when the amount of developer in the storage space 220 increases, the volume of developer accumulation portion increases such that the toner supply port 25 is covered by the developer accumulation portion from below, so that replenishment toner is restrained from flowing in.

The second stirring screw 24 is disposed in the second conveyance passage 222. The second stirring screw 24 has a substantially similar shape to the first stirring screw 23. The second stirring screw 24 is driven to rotate around its rotational axis to convey toner in the direction of an arrow D2 shown in FIG. 9 to thereby supply it to the developing roller 21. As shown in FIG. 9, the developing roller 21 has a greater width than the first stirring screw 23 and the second stirring screw 24 (storage space 220) in the left-right direction.

A layer thickness regulating member 26 is disposed above and opposite the developing roller 21. The layer thickness regulating member 26 is in the form of a plate and supported on the left wall 210L and the right wall 210R at laterally opposite ends thereof. The layer thickness regulating member 26 regulates the layer thickness of toner supplied on the developing roller 21.

The toner container 30 (FIG. 3) is mounted in the above-mentioned container housing portion 30H and disposed above the toner supply port 25 of the development housing 210. Specifically, the toner container 30 includes a stirring paddle 31, a conveying screw 32, and a toner discharge port 33. The stirring paddle 31 is driven to rotate to stir the toner in the toner container 30 and supplies toner to the conveying screw 32. The conveying screw 32 conveys toner to the toner discharge port 33.

The toner discharge port 33 is disposed in the toner container 30 and corresponds to the toner supply port 25 of the developing device 20 (FIG. 6). Toner falling through the toner discharge port 33 passes through the toner supply port 25 to be supplied to the developing device 20.

Further, the developing device 20 includes the developing device driving mechanism 20G (drive mechanism). When the right cover 20H2 is detached in the state shown in FIG. 7, the developing device driving mechanism 20G disposed on the right wall 210R is exposed as shown in FIG. 8. The developing device driving mechanism 20G is connected to respective right ends of the developing roller 21, the first stirring screw 23, and the second stirring screw 24. The developing device driving mechanism 20G is connected to an unillustrated motor provided in the housing 101 of the printer 100 to thereby transmit a torque to the developing roller 21, the first stirring screw 23, and the second stirring screw 24. Further, the developing device driving mechanism 20G transmits a torque to the stirring paddle 31 and the conveying screw 32 of the toner container 30. The developing device driving mechanism 20G includes a plurality of gears axially supported on the right wall 210R.

Figure 13:
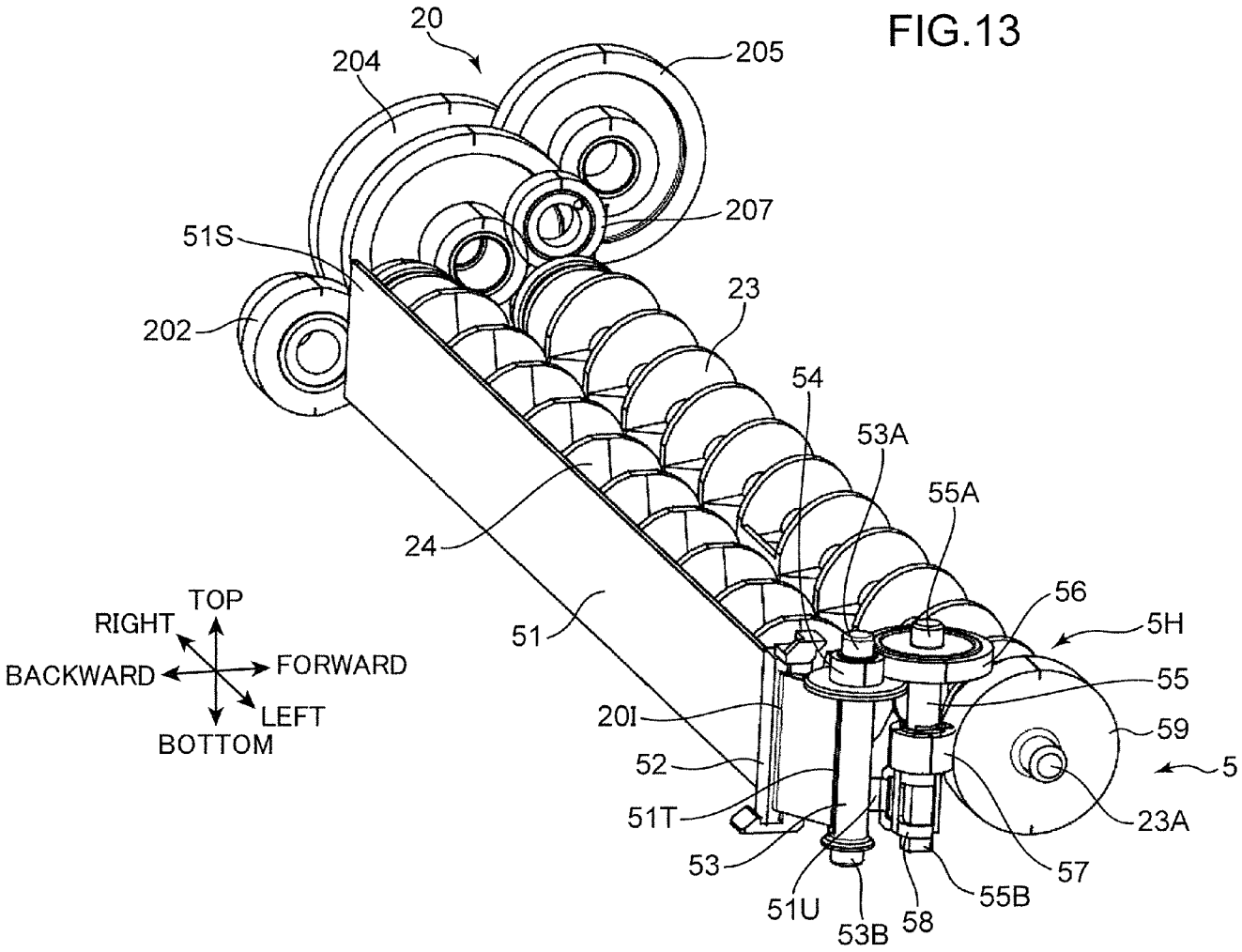
FIG. 13 is a perspective view showing the inside of the developing device according to the embodiment of the present invention.

With reference to FIG. 8, the developing device driving mechanism 20G includes an input gear 201, a first idler gear 202, a developing roller gear 203, a second idler gear 204, a third idler gear 205, a container gear 206, and a fourth idler gear 207 (FIG. 13). The input gear 201 is configured to have a couplable shape, and is connected to the above-mentioned motor upon mounting of the developing device 20 in the housing 101. The first idler gear 202 is connected to the input gear 201 and also to the developing roller gear 203 and the second idler gear 204. The developing roller gear 203 is secured to a developing roller shaft 21A having the rotational axis of the developing roller 21. The input gear 201 transmits a received torque to the developing roller 21 via the first idler gear 202 and the developing roller gear 203. Further, the second idler gear 204 and the fourth idler gear 207 are rotated via the first idler gear 202 to drive the first stirring screw 23 and the second stirring screw 24 for rotation. Further, the rotation of the second idler gear 204 is transmitted to the stirring paddle 31 and the stirring screw 32 of the toner container 30 via the third idler gear 205 and the container gear 206.

Figure 10:
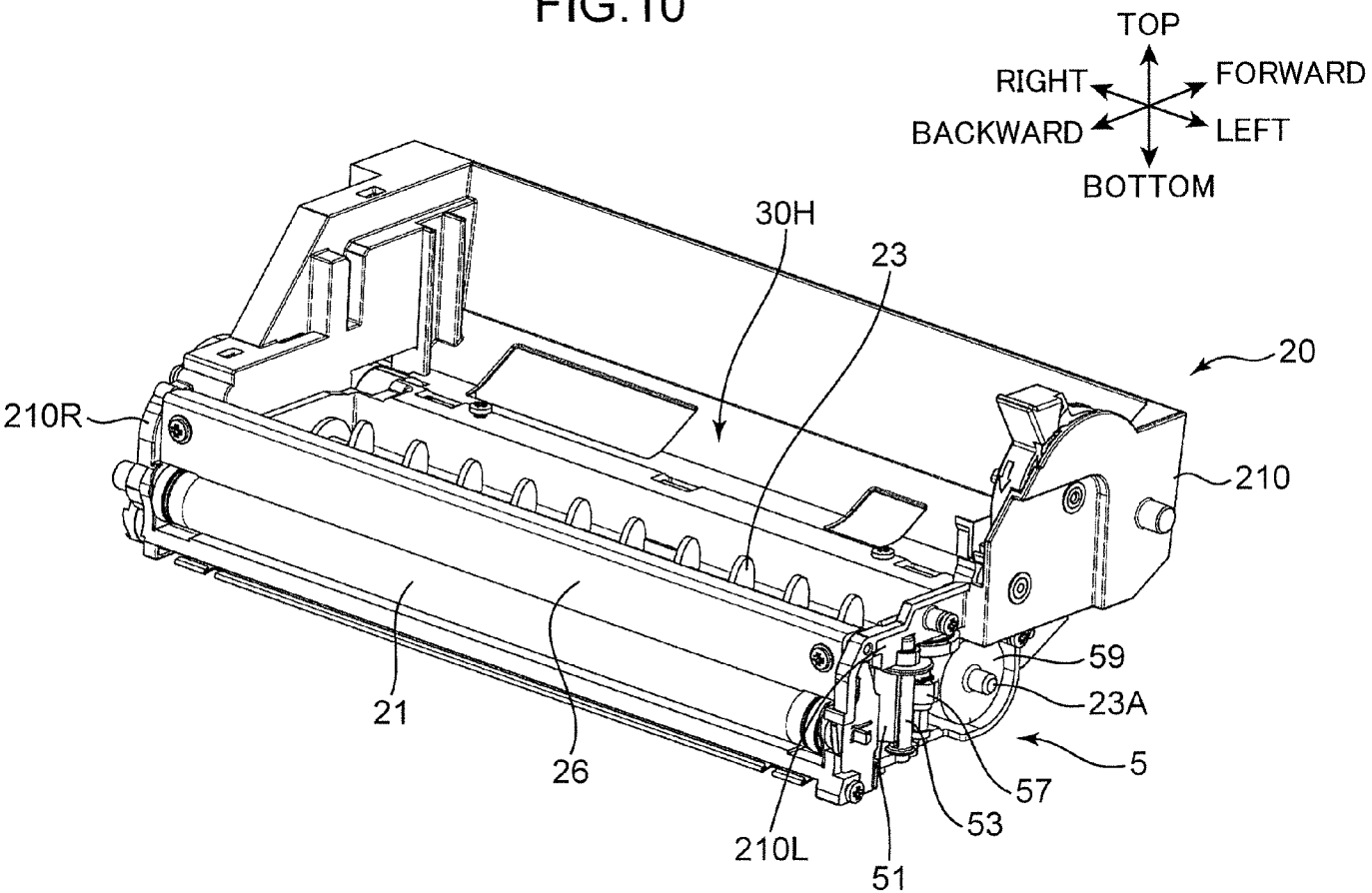
FIG. 10 is a perspective view of the developing device according to the embodiment of the present invention.
Figure 12B:
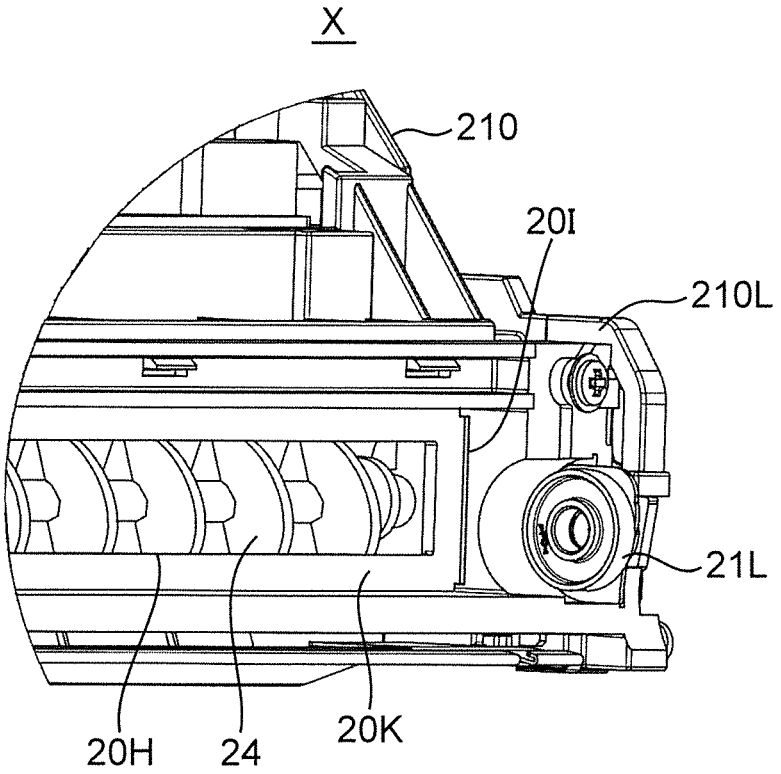
FIG. 12B is an enlarged perspective view of a part of the developing device shown in FIG. 12A.
Figure 14:
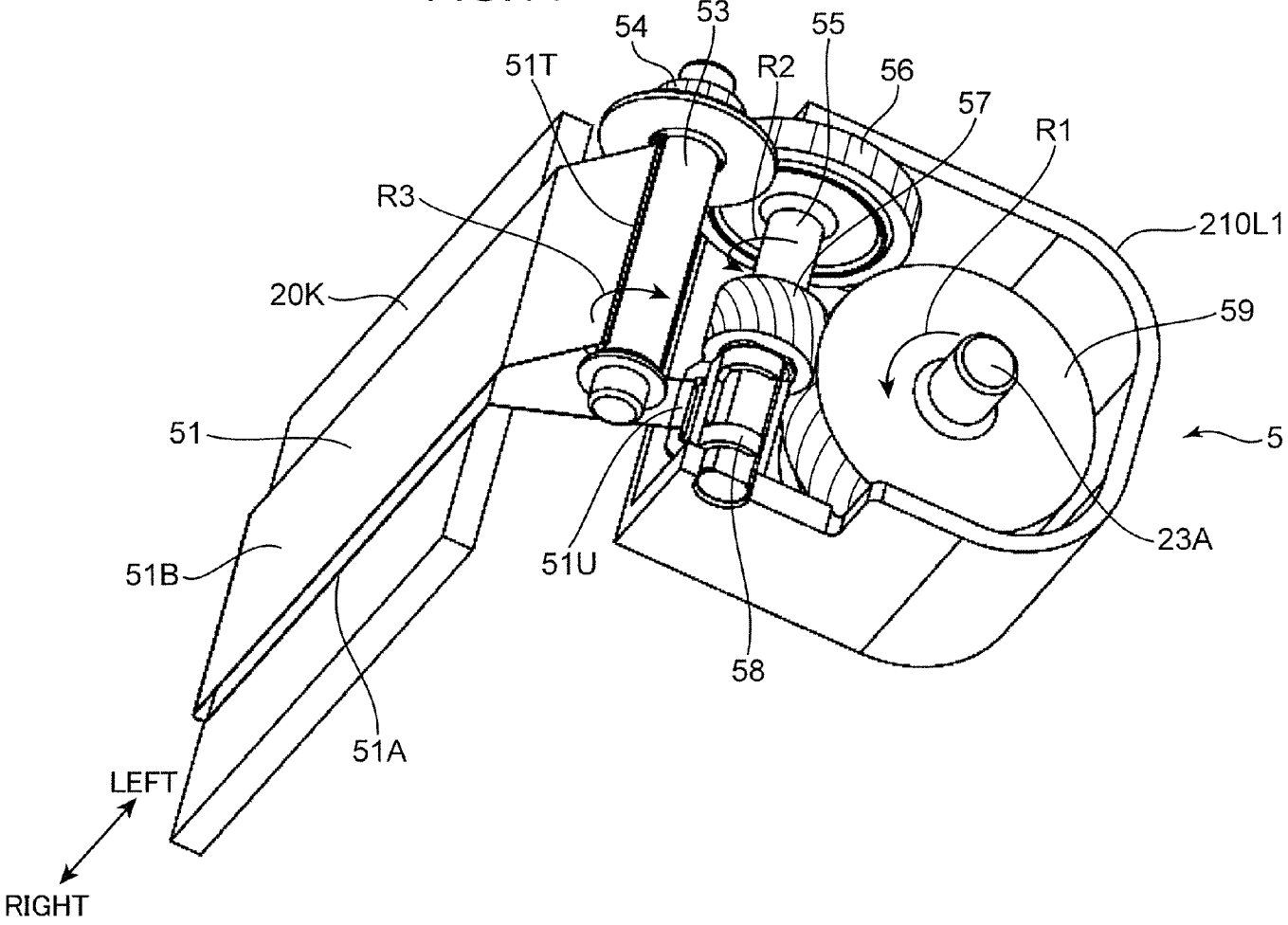
FIG. 14 is a perspective view of a winder mechanism according to the embodiment of the present invention.

Now, filling of toner into the developing device 20 and the structure of the seal winder mechanism 5 in this embodiment will be described with reference to FIGS. 10 to 14. FIG. 10 is a perspective view of the developing device 20 according to this embodiment. FIG. 11A is a front view of the developing device 20 with the developing roller 21 detached and a sealing tape 51 described later peeled off. FIG. 11B is a front view similar to FIG. 11A, but with the sealing tape 51 being attached. FIG. 12A is a perspective view of the developing device 20 shown in FIG. 11A. FIG. 12B is an enlarged perspective view of a part (region X) shown in FIG. 12A. FIG. 13 is a perspective view showing the inside of the developing device 20. It should be noted that in FIG. 13, the development housing 210 is not shown in order to show the relative positions of the components in the development housing 210. FIG. 14 is a perspective view of the seal winder mechanism 5 (winder mechanism) according to this embodiment.

If toner is not filled in a storage space 220 of a developing device 20 in the stage of shipping a printer 100 after manufacture of the printer 100, it will be necessary to fill toner in the storage space 220 at a place of installation of the printer 100. In this case, the time required for setting the printer 100 will be increased. In particular, in the case where toner is supplied from a container 30 until filling the entirety of the storage space 220, the above-mentioned setting time will be further increased owing to the supplying ability of a conveying screw 32 configured to supply a small amount of toner. For this reason, it is preferred that the toner is filled in the storage space 220 before the printer 100 is shipped. However, in this case, toner is liable to come out of the storage space 220 and adhere to the circumferential surface of the developing roller 21 owing to vibrations during transportation after the shipment, so that the vicinity of the developing device 20 is liable to be soiled with the toner.

Accordingly, in this embodiment, the developing device 20 includes a supply opening 20H (opening), the sealing tape 51 (sealing member), and the seal winder mechanism 5 (winder mechanism). With reference to FIGS. 11A, 11B, 12A and 12B, the development housing 210 of the developing device 20 includes a supply partition 20K. The supply partition 20K stands vertically behind the second stirring screw 24. The supply partition 20K functions to separate the second stirring screw 24 from the developing roller 21. In other words, the developing roller 21 is disposed opposite the storage space 220 across the supply partition 20K. The supply opening 20H is formed in the supply partition 20K and communicates with the storage space 220. The supply opening 20H is formed in a portion slightly inner from the outer periphery of the supply partition 20K and has a longer dimension in the left-right direction. Further, with reference to FIG. 11A, the supply opening 20H is disposed in laterally inside of the pair of right bearing 21R and left bearing 21L. The supply opening 20H corresponds to a developer carrying region of the circumferential surface of the developing roller 21 on which toner is carried. Consequently, the opposite ends of the developing roller shaft 21A (FIG. 8) of the developing roller 21, and the right bearing 21R and the left bearing 21L are disposed in axially outside of the supply opening 20H.

The sealing tape 51 adheres to (is attached to) the partition plate 20K around the supply opening 20H as a result of thermal welding. The sealing tape 51 seals the supply opening 20H in a longitudinal direction of the supply opening 20H. Before shipment of the printer 100, toner is filled in the storage space 220 with the supply opening 20H being sealed by the sealing tape 51. The printer 100 is shipped in this state. This makes it possible, even if vibrations are applied to the developing device 20 during transportation, to prevent the toner from flowing to the developing roller 21. Consequently, the inside of the printer 100 is prevented from being soiled with toner. The sealing tape 51 is automatically wound up by the seal winder mechanism 5 upon installation of the printer 100 at a place of use. Therefore, there is no need to temporarily dismount the developing device 20 from the housing 101 to peel the sealing tape 51 in order to begin use of the printer 100.

With reference to FIGS. 13 and 14, the sealing tape 51 includes a seal base end portion 51T (second end) and a seal support portion 51U (first end). The seal based end portion 51T and the seal support portion 51U are defined by longitudinally opposite ends of the sealing tape 51. When the sealing tape 51 is thermally welded to the supply partition 20K to seal the supply opening 20H, the seal support portion 51U of the sealing tape 51 is disposed on the left (longitudinally one end side) of the supply partition 20K (FIG. 14). Subsequently, a sealing surface of the sealing tape 51 is adhered on the supply partition 20K to a right end (the longitudinally other end side) to seal the supply opening 20H, and the sealing tape 51 is then folded back leftward (a seal reverse fold 51S shown in FIG. 13). Thereafter, the seal base end portion 51T of the sealing tape 51 is disposed on the left of the supply partition 20K and behind the seal support portion 51U (FIG. 13). As a result, as shown in FIG. 14, a first seal fold side 51A of the sealing tape 51 is thermally welded to the supply partition 20K and a second seal fold side 51B is disposed behind the first seal fold side 51A in a superposed manner as a portion to be utilized for the peeling. A left end curvature of the sealing tape 51 shown in FIG. 14 is held by a sponge support portion 210L2 described later (see FIG. 18B).

The seal winder mechanism 5 functions to wind up the sealing tape 51 while peeling the sealing tape 51 from the development housing 210. With reference to FIG. 10, the seal winder mechanism 5 is disposed on the left wall 210L of the development housing 210. In particular, in this embodiment, the seal winder mechanism 5 is disposed in front of a left end of the developing roller 21 and on the left of the first stirring screw 23 and the second stirring screw 24, using the difference in length between the developing roller 21 and the first and second stirring screws 23 and 24 in the axial direction (left-right direction) as shown in FIG. 9.

The seal winder mechanism 5 includes a slit portion 52 (FIG. 13), a winder shaft 53, a winder gear 54, a transmission shaft 55 (relay shaft), a relay gear 56, a movable gear 57, a support clip 58 (interrupting member, support portion), and a screw gear 59 (input gear). The winder gear 54, the relay gear 56, the movable gear 57, and the screw gear 59 constitute a drive transmitter 5H (drive transmission mechanism) according to this embodiment. The drive transmitter 5H functions to transmit a torque to the winder shaft 53.

The slit portion 52 (FIG. 13) is in the form of a long narrow member and is disposed at a left end of the supply partition 20K, the slit portion 52 constituting a part of the development housing 210. The slit portion 52 includes a slit 201. The fold side bearing the seal base end portion 51T and the fold side bearing the seal support portion 51U of the sealing tape 51 partially pass through the slit 201, the sealing tape 51 sealing the supply opening 20H (see FIGS. 13 and 18B). When the sealing tape 51 is peeled from the supply partition 20K, the slit 201 is covered by a sealing sponge 60 (FIG. 18B) described later.

The winder shaft 53 is disposed at a left end of the development housing 210 and rotatably supported on the left wall 210L. A winder shaft upper end 53A and a winder shaft lower end 53B shown in FIG. 13 are axially supported on the left wall 210L. The seal base end portion 51T of the sealing tape 51 is adhesively secured to the winder shaft 53.

The winder gear 54 is in the form of a spur gear and is secured to the winder shaft upper end 53A of the winder shaft 53. The winder gear 54 rotates integrally with the winder shaft 53. Further, the winder gear 54 is in engagement with the relay gear 56.

The transmission shaft 55 is disposed adjacently in front of the winder shaft 53. The transmission shaft 55 extends in parallel with the winder shaft 53 and is rotatably supported on the left wall 210L. A transmission shaft upper end 55A and a transmission shaft lower end 55B shown in FIG. 13 are axially supported on the left wall 210L.

The relay gear 56 is in the form of a spur gear and is secured to the transmission shaft upper end 55A of the transmission shaft 55. The relay gear 56 rotates integrally with the transmission shaft 55.

The movable gear 57 is mounted to the transmission shaft 55 and rotates integrally with the transmission shaft 55, the movable gear 57 being slidable in an axial direction of the transmission shaft 55. The movable gear 57 includes an unillustrated shaft hole in the shape of D. On the other hand, the transmission shaft 55 also includes a D-shaped circumferential surface (see FIG. 16). Consequently, the transmission shaft 55 is rotatable with the rotation of the movable gear 57 and the movable gear 57 is slidable. The movable gear 57 is in the form of a helical gear engageable with the screw gear 59.

The support clip 58 is connected to the transmission shaft 55. Specifically, the support clip 58 includes a pair of clip portions 58A (FIG. 16B) vertically spaced from each other and being substantially in the shape of C, and a connecting portion 58B vertically connecting the pair of clip portions 58A. The clip portions 58A are fitted onto the transmission shaft 55 in a radial direction, whereby the support clip 58 is connected to the transmission shaft 55. At this time, the support clip 58 is mounted to a lower portion (second position) of the transmission shaft 55. Further, the connecting portion 58B fixedly holds the seal support portion 51U of the sealing tape 51. The support clip 58 functions as an interrupting member to interrupt a torque transmission of the drive transmitter 5H owing to a winding force generated when the seal support portion 51U is wound around the winder shaft 53 after the sealing tape 51 is peeled from the supply partition 20K. In other words, the support clip 58 interrupts a torque transmission of the drive transmitter 5H owing to a tension of the sealing member 51 caused by peeling the seal support portion 51U fold side of the sealing tape 51 from the supply partition 20K.

The screw gear 59 engages with the movable gear 57 located at an axially central portion (first position) of the transmission shaft 55 to thereby transmit a torque to the transmission shaft 55 via the movable gear 57. A rotational axis of the screw gear 59 perpendicularly intersects a rotational axis of the transmission shaft 55. Further, in this embodiment, the screw gear 59 is in the form of a helical gear and is secured to a left end of a screw shaft 23A having the rotational axis of the first stirring screw 23. As shown in FIG. 14, the transmission shaft 55, the relay gear 56, the movable gear 57 and the screw gear 59 of the drive transmitter 5H are housed in a housing compartment 210L1 constituting a part of the left wall 210L. The housing compartment 210L1 is in the form of a box which is open at its left end.

Figure 15A:
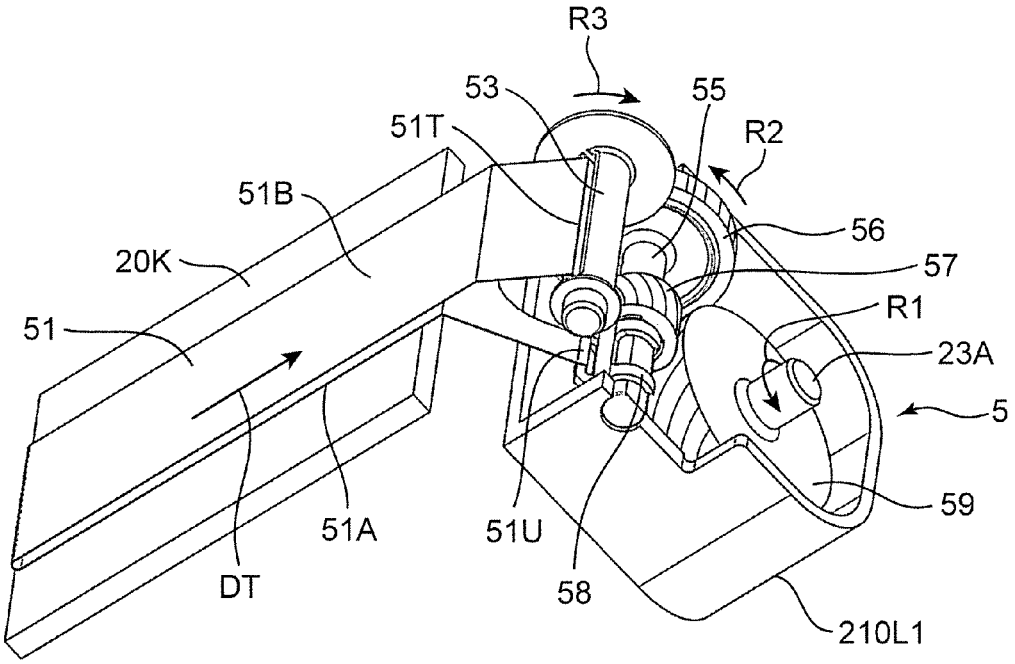
FIG. 15A is a perspective view illustrating winding of the sealing member by the winder mechanism in the embodiment of the present invention.
Figure 15B:
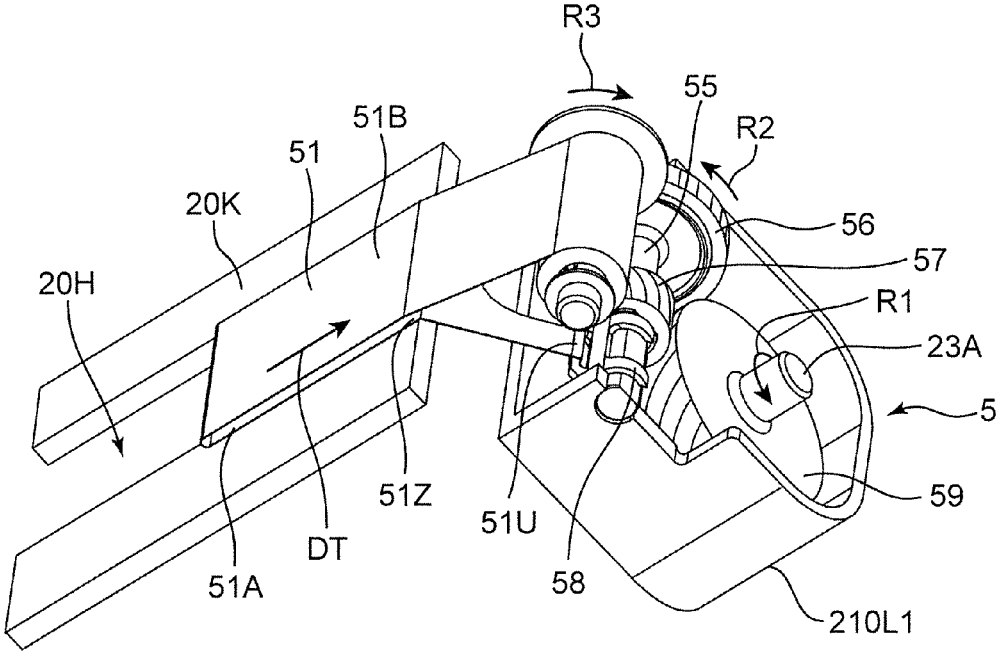
FIG. 15B is a perspective view illustrating the winding of the sealing member by the winder mechanism in the embodiment of the present invention.
Figure 16A:
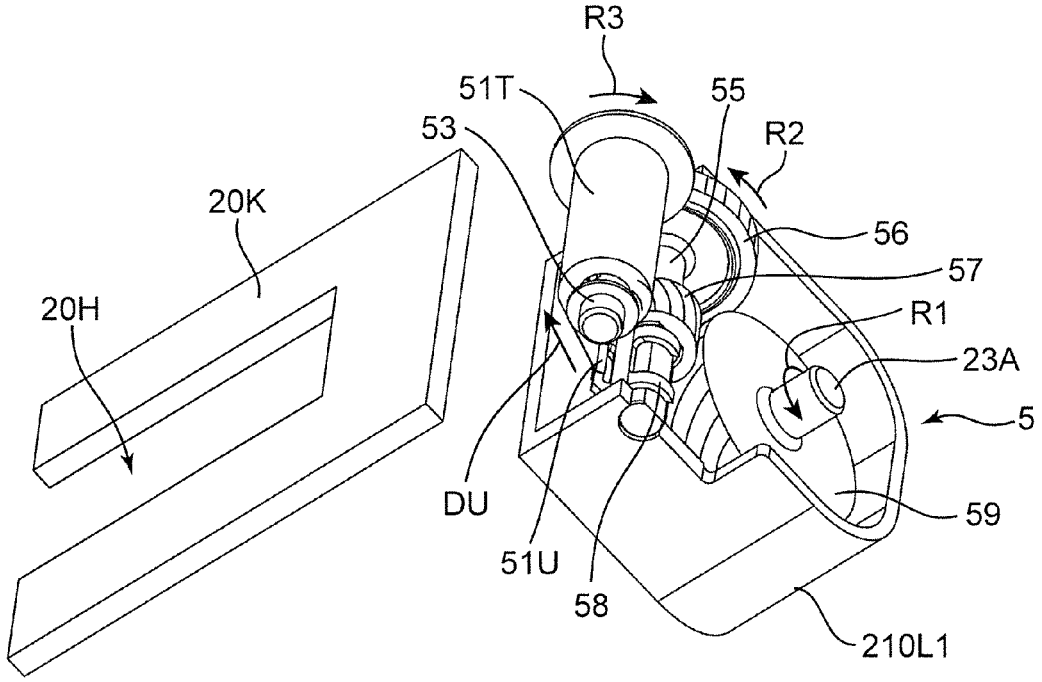
FIG. 16A is a perspective view illustrating the winding of the sealing member by the winder mechanism in the embodiment of the present invention.
Figure 16B:
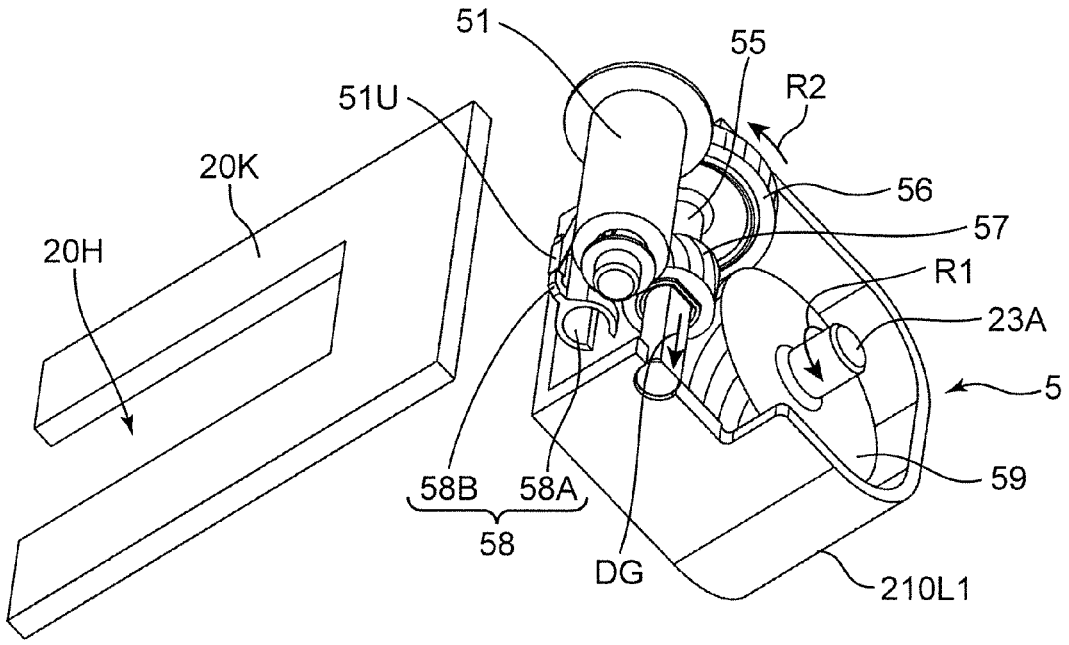
FIG. 16B is a perspective view illustrating the winding of the sealing member by the winder mechanism in the embodiment of the present invention.
Figure 17:
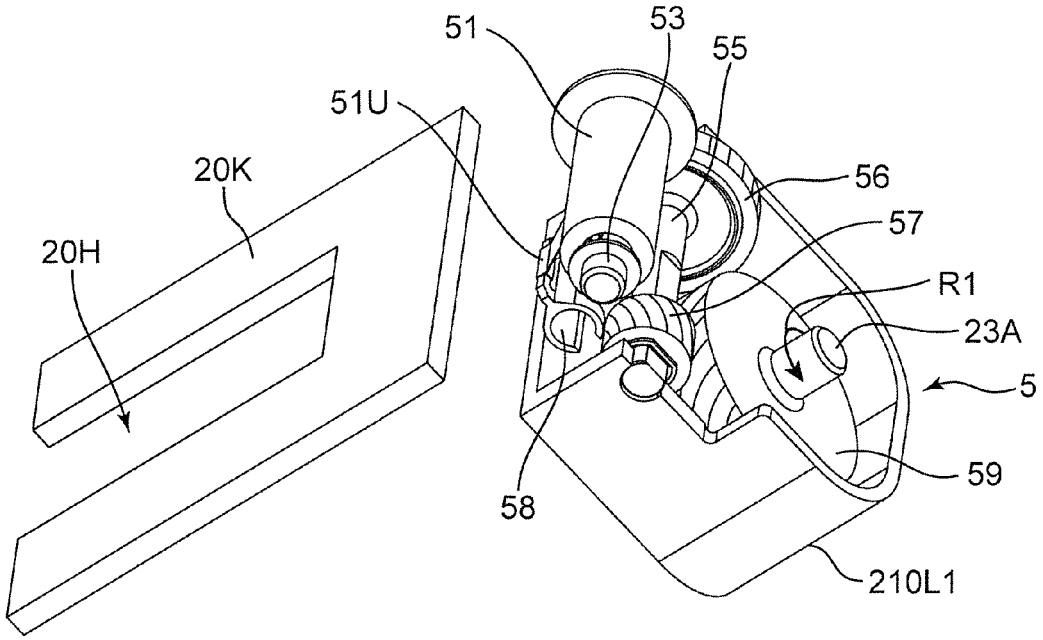
FIG. 17 is a perspective view showing the winder mechanism according to the embodiment of the present invention in which a movable gear is disengaged from an input gear.

Now, an operation of the seal winder mechanism 5 will be described with reference to FIGS. 15A to 17. FIGS. 15A, 15B, 16A, and 16B are perspective views illustrating winding of the sealing tape 51 around the winder shaft 53 by the seal winder mechanism 5. FIG. 17 is a perspective view showing the seal winder mechanism 5 in which the movable gear 57 is disengaged from the screw gear 59 after the winding of the sealing tape 51.

In the state that the storage space 220 (FIG. 8) of the development housing 220 is filled with toner, and the supply opening 20H is sealed by the sealing tape 51, an unillustrated controller inputs a torque to the input gear 201 of the developing device 20. This causes the developing roller 21, the first stirring screw 23, and the second stirring screw 24 to rotate, and the screw gear 59 secured to the screw shaft 23A of the first stirring screw 23 to rotate in the direction of an arrow R1 shown in FIG. 15A. At this time, the support clip 58 holds the movable gear 57, from below, at the position at which the movable gear 57 engages with the screw gear 59. Therefore, the screw gear 59 transmits the torque to the movable gear 57 to thereby rotate the movable gear 57, the transmission shaft 55 and the relay gear 56 in the direction of an arrow R2 shown in FIG. 15A. The transmission shaft 55 rotates while coming into a frictional contact with the inner surfaces of the clip portions 58A of the support clip 58. Further, the engagement between the relay gear 56 and the winder gear 54 causes the winder gear 54 and the winder shaft 53 to rotate in the direction of an arrow R3 shown in FIG. 15A. Consequently, the sealing tape 51 begins to be wound around the winder shaft 53 gradually from the seal base end portion 51T, so that the supply opening 20H is opened from the right side (FIG. 15B).

The sealing tape 51 continues to be wound until a seal separating portion 51Z (FIG. 15B) of the first seal fold side 51A that is adhered to the left end of the supply partition 20K is peeled from the supply partition 20K. As a result, the sealing tape 51 stretches between the winder shaft 53 and the support clip 58 as shown in FIG. 16A. Further rotation of the winder shaft 53 causes the support clip 58 to be pulled in the direction of an arrow DU shown in FIG. 16A, so that the support clip 58 disengages from the transmission shaft 55 owing to the force to wind the sealing member 51 (FIG. 16B).

When the support clip 58 disengages from the transmission shaft 55, the movable gear 57 slides downwardly to the second position from the axially central position of the transmission shaft 55 (in the direction of an arrow DG shown in FIG. 16B), owing to a thrust generated by the engagement of the movable gear 57 and the screw gear 59. As a result, as shown in FIG. 17, the movable gear 57 disengages from the screw gear 59, whereby the torque transmission from the screw gear 59 to the transmission shaft 55 is interrupted. Thereafter, the developing roller 21, the first stirring screw 23 and the second stirring screw 24 are rotationally driven in order to perform the developing operation in the developing device 20. At this time, in FIG. 17, the screw gear 59 rotates with the screw shaft 23A of the first stirring screw 23, but the other components of the seal winder mechanism 5 do not rotate. This prevents the support clip 58 from rotating to make contact with the surrounding components and generating abnormal noise after the sealing tape 51 is wound up.

As described, in this embodiment, the sealing tape 51 sealing the supply opening 20H of the development housing 210 is wound up by the seal winder mechanism 5 to thereby allow toner to flow through the supply opening 20H to be supplied to the developing roller 21. Further, the support clip 58 interrupts the torque transmission of the drive transmitter 5H owing to the winding force generated when the seal support portion 51U of the sealing tape 51 is wound up. Therefore, it is possible to reliably interrupt the torque transmission to the winder shaft 53 after the sealing tape 51 is completely peeled off. Specifically, the winding force is not exerted on the seal support portion 51U of the sealing tape 51 while the sealing tape 51 is being peeled. This prevents accidental interruption of the torque transmission of the drive transmitter 5H. Consequently, it is possible to peel the sealing tape 51 automatically and reliably. Further, the support clip 58, while being mounted on the transmission shaft 55, functions to hold the movable gear 57 at the position at which the movable gear 57 engages with the screw gear 59. Therefore, a torque to the transmission shaft 55 can be transmitted or interrupted depending on whether the support clip 58 is mounted on or dismounted from the transmission shaft 55. Further, in this embodiment, it is possible to wind up the sealing tape 51 by utilizing a torque transmitted from the developing device driving mechanism 20G to the first stirring screw 23. In other embodiments, it may be configured such that the sealing tape 51 is wound up by utilizing a torque transmitted to the developing roller 21. Alternatively, it may be configured such that the sealing tape 51 is wound up by utilizing a torque transmitted to the toner container 30 or the photoconductive drum 121 disposed on the housing 101.

Figure 18A:
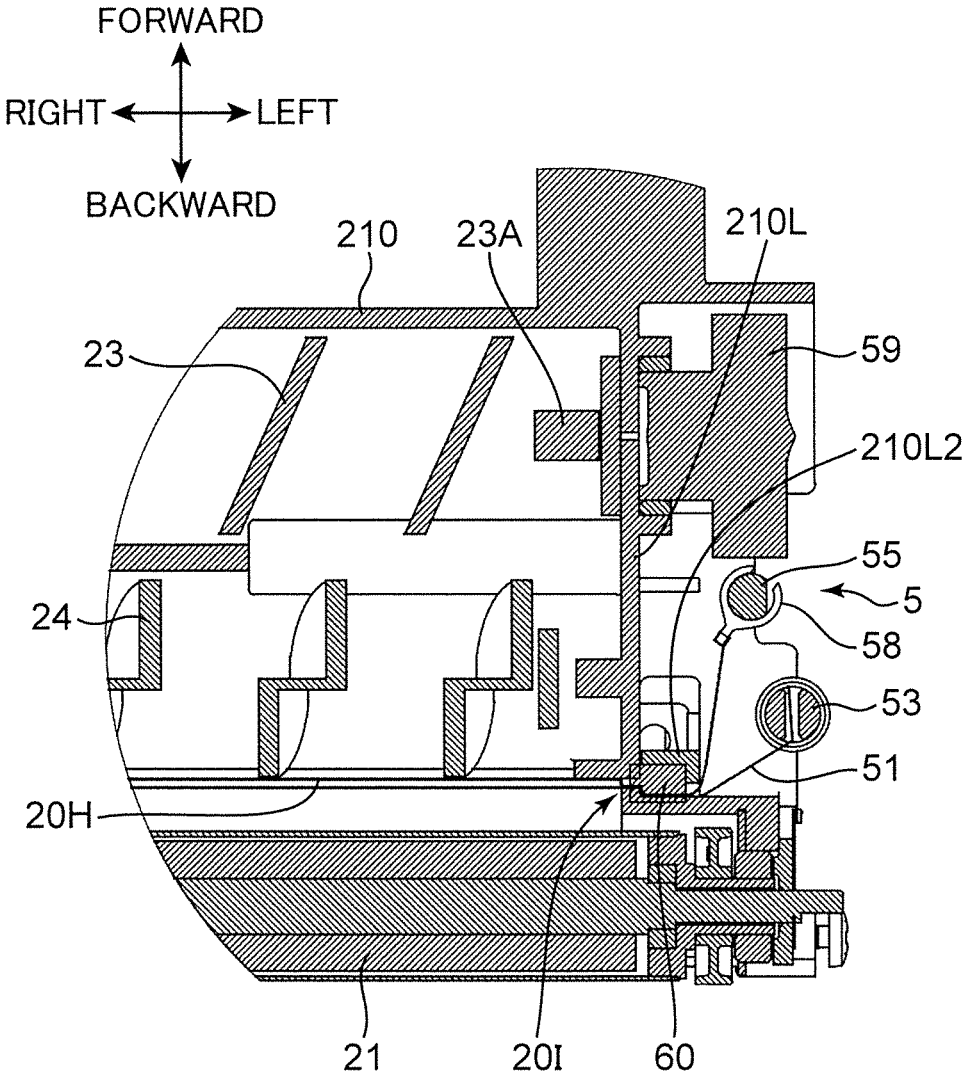
FIG. 18A is a sectional view of a part of the developing device according to the embodiment of the present invention.
Figure 18B:
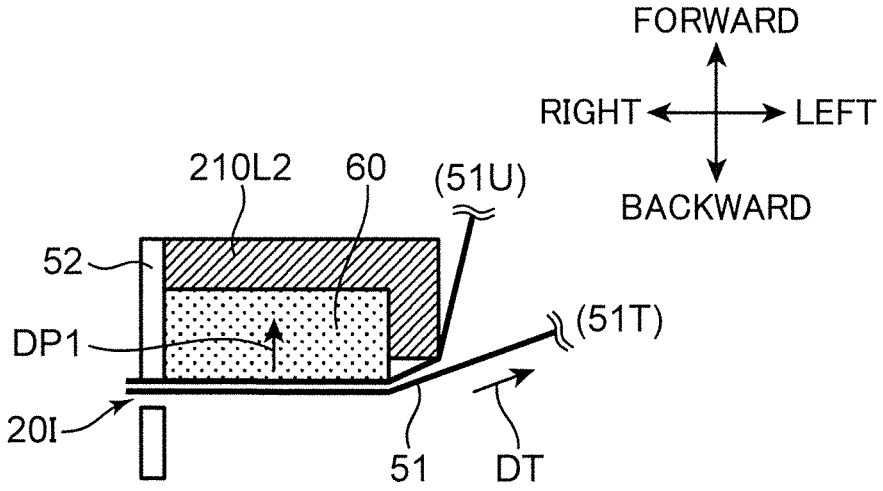
FIG. 18B is a schematic enlarged view of the vicinity of an elastic member of the developing device according to the embodiment of the present invention.
Figure 18C:
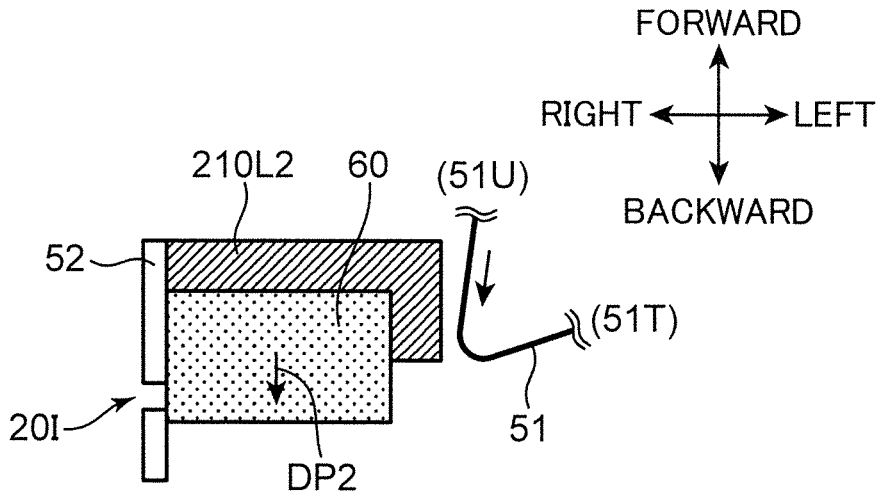
FIG. 18C is a schematic enlarged view of the vicinity of the elastic member of the developing device according to the embodiment of the present invention.

Further, FIG. 18A is a sectional view of the vicinity of the seal winder mechanism 5 of the developing device 20 according to this embodiment. FIGS. 18B and 18C are schematic enlarged views showing the vicinity of the sealing sponge 60 of the developing device 20. As described above, in this embodiment, the sealing tape 51 passes through the slit 201 formed on the left side of the supply opening 20H. The toner in the storage space 220 is prevented from leaking out to the seal winder mechanism 5 or to the outside of the developing device 20 by using the slit 201 for the winding of the sealing tape 51. Further, the developing device 20 includes the sponge support portion 210L2 and the sealing sponge 60 (elastic member). With reference to FIG. 18B, the sponge support portion 210L2 is in the form of a wall constituting a part of the left wall 210L and is disposed adjacently to the slit portion 52. The sponge support portion 210L2 extends leftward from the slit portion 52 and has a leading end extending rearward. The sealing sponge 60 has a cuboid shape and is disposed in a space having U-shape in top view defined by the slit portion 52 and the sponge support portion 210L2. The sealing sponge 60 has a facing surface disposed in front of and facing the sealing tape 51.

As shown in FIG. 18B, the sealing sponge 60 is pushed by the seal support portion 51U fold side of the sealing tape 51 sealing the supply opening 20H, and is thereby resiliently compressed forwardly (in the direction of an arrow DP1). In this state, the sealing tape 51 is wound up (in the direction of an arrow DT) until the sealing tape 51 comes out of the slit 201 and is detached from the sealing sponge 60, so that the compression of the sealing sponge 60 is released (in the direction of an arrow DP2 shown in FIG. 18C). At this time, a right end surface of the sealing sponge 60 covers the slit 201 from the outside. This prevents toner passing from the storage space 220 through the supply opening 20H from flowing out to the seal winder mechanism 5. Thus, the sealing sponge 60 can be used to cover and open the slit 201 by making use of the pushing force of the sealing tape 51.

The developing device 20 and the printer 100 including the same according to the embodiment of the present invention have been described. This configuration makes it possible to peel the sealing tape 51 sealing the supply opening 20H automatically and reliably. Consequently, a toner image can be stably carried on the photoconductive drum 121, which makes it possible to form a stable image on a sheet S. The present invention is not limited to the above-described embodiment and, for example, the following modified embodiments may be adopted.

Figure 19:
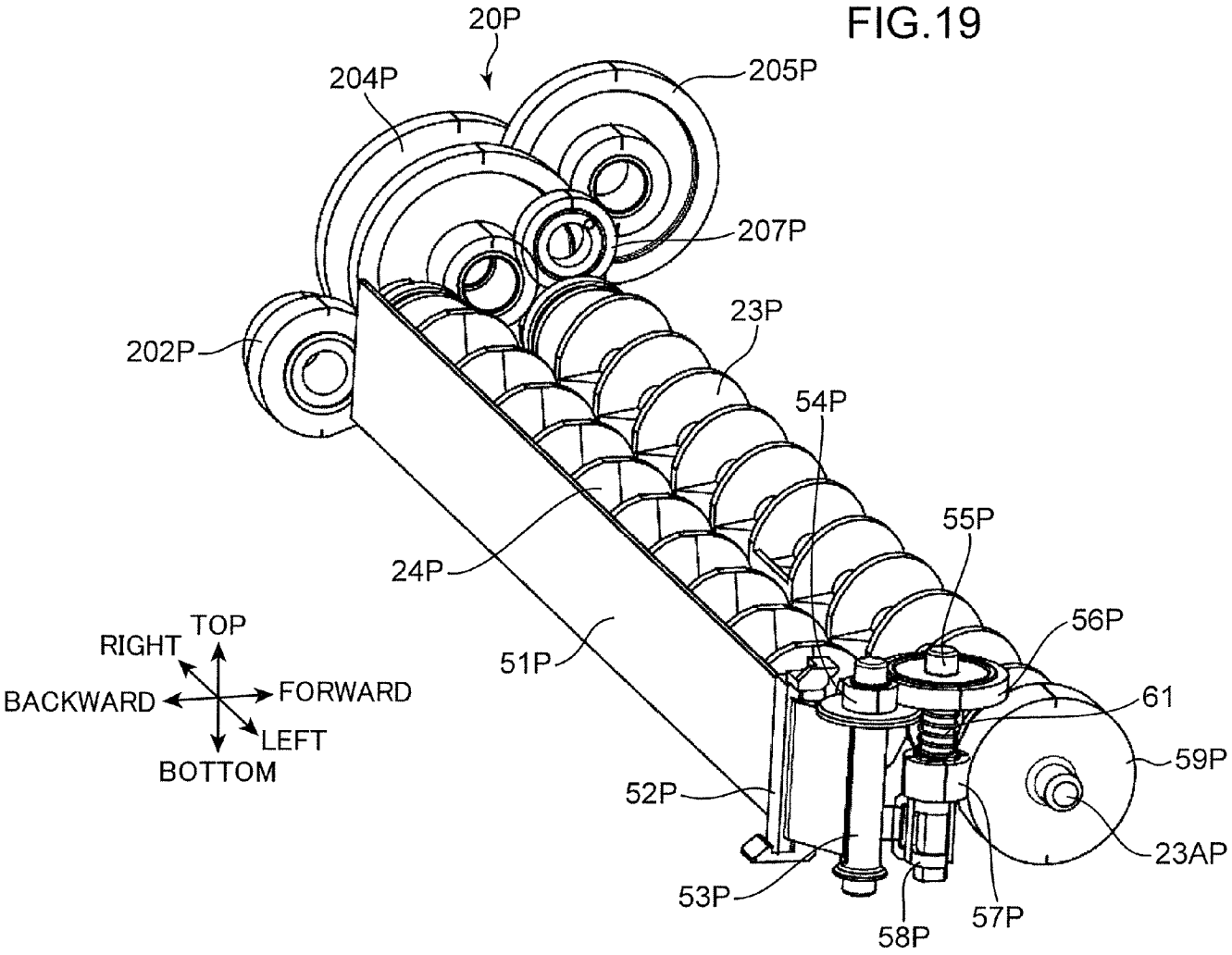
FIG. 19 is a perspective view showing the inside of a developing device according to another embodiment of the present invention.

(1) In the above-described embodiment, the movable gear 57 slides owing to a thrust of the helical gears, i.e. the movable gear 57 and the screw gear 59, after the support clip 58 disengages from the transmission shaft 55. In this case, the movable gear 57 is allowed to slide by the simple configuration of the movable gear 57 and the screw gear 59. However, it should be noted that the present invention is not limited to this configuration. FIG. 19 is a perspective view showing the inside of a developing device 20P according to a modified embodiment of the present invention. In FIG. 19, elements that have structures and functions identical to those of the corresponding elements of the developing device 20 of the above-described embodiment are denoted by the same reference numerals as in the above-described embodiment, with "P" added at the end. The developing device 20P differs from the developing device 20 of the above-described embodiment in the aspect of including a spring 61 (biasing member). The spring 61 is placed around a transmission shaft 55P and biases a movable gear 57P toward a support clip 58P. According to this configuration, when the support clip 58P disengages from the transmission shaft 55P, the movable gear 57P slides downward from an axially central portion of the transmission shaft 55P owing to a biasing force of the spring 61. This allows the movable gear 57P to reliably disengage from a screw gear 59P.

Figure 20A:
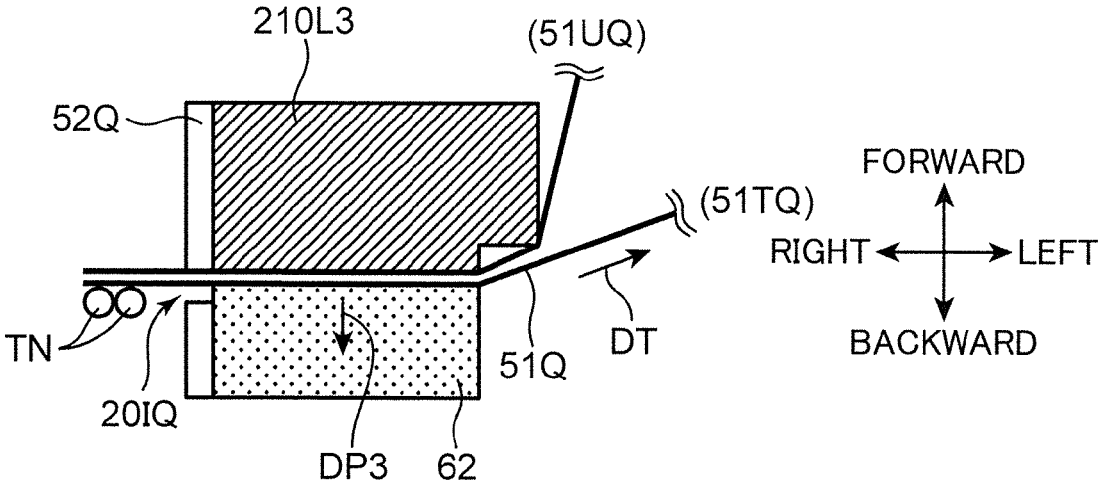
FIG. 20A is a schematic enlarged view of the vicinity of an elastic member of a developing device according to another embodiment of the present invention.
Figure 20B:
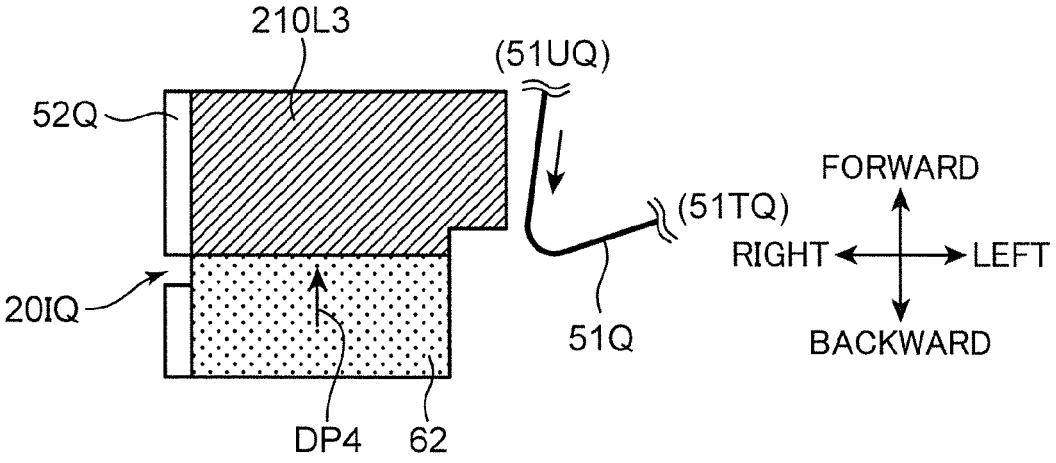
FIG. 20B is a schematic enlarged view of the vicinity of the elastic member of the developing device according to the another embodiment of the present invention.

(2) Further, in the above-described embodiment, the sealing sponge 60 is disposed in front of the sealing tape 51 as shown in FIGS. 18B and 18C. However, the present invention is not limited to this configuration. FIGS. 20A and 20B are schematic enlarged views of the vicinity of a cleaning sponge 62 of a developing device according to a modified embodiment of the present invention. In FIGS. 20A and 20B, elements that have structures and functions identical to those of the corresponding elements of the developing device 20 of the above-described embodiment are denoted by the same reference numerals as in the above-described embodiment, with "Q" added at the end. The developing device includes a sponge-facing portion 210L3 and the cleaning sponge 62 (elastic member).

In this modified embodiment, the cleaning sponge 62 is secured to a slit portion 52Q behind a sealing tape 51Q. The sponge-facing portion 201L3 is in the form of a wall and is disposed opposite the cleaning sponge 62 across the sealing tape 51Q. The cleaning sponge 62 is pushed by a fold side bearing a seal base end portion 51TQ of the sealing tape 51 in the state that the sealing tape 51 seals an unillustrated supply opening, and is thereby resiliently deformed rearwardly (in the direction of an arrow DP3 shown in FIG. 20A). In this state, the sealing tape 51Q is wound up (in the direction of an arrow DT) until the sealing tape 51Q comes out of a slit 20IQ and is detached from the cleaning sponge 62, so that the compression of the cleaning sponge 62 is released (in the direction of an arrow DP4 shown in FIG. 20B). At this time, a right end surface of the sealing sponge 62 covers the slit 20IQ from the outside.

In this modified embodiment, the sealing tape 51 is wound around an unillustrated winder shaft with a tape surface (surface) of the sealing tape 51Q that faces a storage space of toner coming into contact with the cleaning sponge 62. This allows the cleaning sponge 62 to have a cleaning function to remove toner (TN shown in FIG. 20A) from the tape surface of the sealing tape 51Q. Therefore, it is possible to further prevent the vicinity of the winder mechanism from being stained with splattered toner. Further, this modified embodiment shown in FIGS. 20A and 20B is advantageous compared to the embodiment shown in FIGS. 18B and 18C in that the slit 20IQ is covered even while the sealing tape 51Q is being wound. Further, in this modified embodiment, the sealing tape 51Q is wound up while being held between the cleaning sponge 62 and the sponge-facing portion 210L3. Therefore, fluctuations in the resilient force (restoring force) of the cleaning sponge 62 during the winding are not likely to affect the performance of winding the sealing tape 51Q.

(3) Further, the developer container is illustrated as the developing device 20 in the above-described embodiment. However, the present invention is not limited to this configuration. The developer container may be configured as a toner container 30. Specifically, it may be configured such that a toner discharge port 33 of the toner container 30 is sealed by a sealing tape 51 and, in order to begin use of the printer 100, the sealing tape 51 is peeled by a seal winder mechanism 5 to allow supply of toner from the toner container 30 to a developing device 20.

The invention claimed is:

1. A developer container, comprising:

a housing including a storage space configured to contain developer, and an opening having a longer dimension and communicating with the storage space for allowing the developer to flow therethrough;

a sealing member attached to the housing and sealing the opening in a longitudinal direction of the opening; and a winder mechanism configured to wind up the sealing member while peeling the sealing member from the housing, wherein the sealing member is in a folded state that a first end of the sealing member and a second end opposite to the first end are disposed on one end of the housing in the longitudinal direction and a crease of the sealing member is on the other end of the housing in the longitudinal direction with a sealing surface of the sealing member sealing the opening, the winder mechanism includes a winder shaft disposed at the one end of the housing in the longitudinal direction and fixedly holding the second end of the sealing member, a drive transmission mechanism configured to transmit a torque to the winder shaft, and an interrupting member fixedly holding the first end of the sealing member and connected to the drive transmission mechanism, the interrupting member being operable to interrupt the transmission of the torque of the drive transmission mechanism owing to a tension of the sealing member caused by peeling the first end fold side of the sealing member from the housing.

2. A developer container according to claim 1, wherein the winder mechanism further includes a relay shaft disposed adjacently to the winder shaft, the drive transmission mechanism includes a relay gear secured to the relay shaft, a winder gear secured to the winder shaft and engaged with the relay gear, a movable gear mounted to the relay shaft, and integrally rotatable with the relay shaft and slidable in an axial direction of the relay shaft, and an input gear engageable with the movable gear located at a first position of the relay shaft in an axial direction, the input gear being configured to transmit the torque to the relay shaft via the movable gear, and the interrupting member includes a support portion mounted to a second position of the relay shaft in the axial direction and holding the movable gear at the first position, the support portion being disengageable from the relay shaft owing to the winding force, the disengagement of the support portion from the relay shaft allowing the movable gear to slide from the first position to the second position at which the input gear disengages from the movable gear to thereby interrupt the transmission of the torque from the input gear to the relay shaft.

3. A developer container according to claim 2, wherein the movable gear and the input gear are each in the form of a helical gear, and the disengagement of the support portion from the relay shaft allows the movable gear to slide from the first position to the second position owing to a thrust generated by engagement of the helical gears.

4. A developer container according to claim 3, further comprising a biasing member disposed on the relay shaft and biasing the movable gear toward the support portion, wherein the disengagement of the support portion from the relay shaft allows the movable gear to slide from the first position to the second position owing to a biasing force of the biasing member.

5. A developer container according to claim 2, further comprising a biasing member disposed on the relay shaft and biasing the movable gear toward the support portion, wherein the disengagement of the support portion from the relay shaft allows the movable gear to slide from the first position to the second position owing to a biasing force of the biasing member.

6. A developer container according to claim 1, wherein the housing is formed with a slit allowing the first end fold side and the second end fold side of the sealing member to pass therethrough in the state that the sealing member seals the opening, further comprising an elastic member disposed in the housing adjacently to the slit, and resiliently compressed by the first end fold side or the second end fold side of the sealing member sealing the opening, the elastic member being operable to close the slit owing to release of the compression when the sealing member is wound around the winder shaft.

7. A developer container according to claim 6, wherein the elastic member is resiliently compressed by the second end fold side of the sealing member sealing the opening, and the sealing member is wound around the winder shaft with a surface of the sealing member that faces the storage space coming into contact with the elastic member.

8. A developer container according to claim 1, comprising:

a conveying member disposed in the housing in the longitudinal direction and configured to be driven to rotate for conveying the developer in the storage space; and a developing roller rotatably supported on the housing at a position opposite to the storage space across the opening and having a circumferential surface operable to carry the developer discharged through the opening.

9. A developer container according to claim 8, further comprising a driving mechanism connected to the conveying member at the other end in the longitudinal direction for transmitting a torque to the conveying member, wherein the drive transmission mechanism is connected to the conveying member at the one end in the longitudinal direction for transmitting the torque transmitted to the conveying member to the winder shaft.

10. An image forming apparatus, comprising:

an image carrier having a surface for allowing an electrostatic latent image to be formed thereon and operable to carry a developed image formed by visualizing the electrostatic latent image by developer;

a developer container according to claim 1 configured to contain the developer; and a transfer section configured to transfer the developed image from the image carrier onto a sheet.

* * * * *